US011365859B2

(12) United States Patent
Hölzl et al.

(10) Patent No.: US 11,365,859 B2
(45) Date of Patent: Jun. 21, 2022

(54) MOTOR VEHICLE HEADLIGHT AND METHOD

(71) Applicant: ZKW Group GmbH, Wieselburg (AT)

(72) Inventors: Andreas Hölzl, Wieselburg (AT); Sascha David, Loich (AT); Matthias Frühwirth, Ybbs (AT); Josef Gürtl, Kilb (AT)

(73) Assignee: ZKW Group GmbH, Wieselburg (AT)

( * ) Notice: Subject to any disclaimer, the term of this patent is extended or adjusted under 35 U.S.C. 154(b) by 48 days.

(21) Appl. No.: 16/770,032

(22) PCT Filed: Dec. 3, 2018

(86) PCT No.: PCT/EP2018/083289
§ 371 (c)(1),
(2) Date: Jun. 4, 2020

(87) PCT Pub. No.: WO2019/110476
PCT Pub. Date: Jun. 13, 2019

(65) Prior Publication Data

US 2021/0172577 A1 Jun. 10, 2021

(30) Foreign Application Priority Data

Dec. 4, 2017 (EP) ..... 17205071

(51) Int. Cl.
*F21S 41/25* (2018.01)
*F21S 41/29* (2018.01)
(Continued)

(52) U.S. Cl.
CPC ..... *F21S 41/25* (2018.01); *F21S 41/295* (2018.01); *F21S 41/635* (2018.01); *F21V 5/007* (2013.01); *F21S 45/47* (2018.01)

(58) Field of Classification Search
CPC ..... F21S 41/25; F21S 41/295; F21S 41/635; F21S 45/47; F21S 41/143; F21S 41/19; F21S 41/29; F21S 41/663; F21V 5/007
See application file for complete search history.

(56) References Cited

U.S. PATENT DOCUMENTS

2013/0327964 A1* 12/2013 Otsuka ..... B60Q 1/0683 250/504 R
2017/0219186 A1* 8/2017 Enno ..... F21V 5/007
(Continued)

FOREIGN PATENT DOCUMENTS

EP 2827049 A2 1/2015
FR 3008475 A1 1/2015

OTHER PUBLICATIONS

International Search Report for PCT/EP2018/083289, dated Feb. 20, 2019 (5 pages).
(Continued)

*Primary Examiner* — Zheng Song
(74) *Attorney, Agent, or Firm* — Eversheds Sutherland (US) LLP

(57) ABSTRACT

The invention relates to a motor vehicle headlight (1) comprising a light module having a plurality of light sources (110, 120, 130) and a plurality of primary optics (210, 220, 230), wherein the light sources (110, 120, 130) each have a light-emitting surface (111, 121, 131) and are arranged on a common circuit board (50). The circuit board (50) has a circuit board reference point and a light reference plane, wherein the light reference plane is defined by at least three light reference points, and the circuit board reference point lies in the light reference plane. The primary optics (210, 220, 230) each have a light-incoupling surface (211, 221, 231) and a light-outcoupling surface (212, 222, 232), and are held in position by a common holder (60). The holder (60) has a holder reference point and an optics reference plane,
(Continued)

which is defined by at least three optics reference points (21, 22, 23) and in which the holder reference point also lies. At least three spacer means (41, 42) are arranged between the circuit board (50) and the holder (60) at the respective light reference points and optics reference points.

28 Claims, 8 Drawing Sheets

(51) Int. Cl.

| | |
|---|---|
| ***F21S 41/63*** | (2018.01) |
| ***F21V 5/00*** | (2018.01) |
| *F21S 45/47* | (2018.01) |

(56) References Cited

U.S. PATENT DOCUMENTS

| | | | | |
|---|---|---|---|---|
| 2018/0142854 | A1 | 5/2018 | Nakao et al. | |
| 2018/0264994 | A1* | 9/2018 | Stoehr | F21S 41/265 |
| 2019/0017676 | A1* | 1/2019 | Van Straten | F21S 41/141 |
| 2020/0149701 | A1* | 5/2020 | Monestier | F21S 41/39 |

OTHER PUBLICATIONS

Search Report for European Patent No. 17205071, dated Jun. 5, 2018 (1 page).

* cited by examiner

MOTOR VEHICLE HEADLIGHT AND METHOD

The invention relates to a motor vehicle headlight comprising a light module with a plurality of light sources, which each have a light-emitting surface and are arranged on a common circuit board, and a plurality of primary optics, which each have a light-incoupling surface and a light-outcoupling surface, and are held in position by a common holder, wherein each light source is configured to emit light from the respective light-emitting surface, and to incouple light into a respectively associated light-incoupling surface.

The invention also relates to a method for the adjustment of a plurality of light sources and a plurality of primary optics of a motor vehicle headlight relative to one another.

In the development of current headlight systems, the focus is increasingly on the desire to be able to project a light pattern onto the road surface with as high a resolution as possible, which light pattern can be altered quickly and adapted to the respective traffic, road and lighting conditions. The term "road surface" is used here for the sake of simplification, because it naturally depends on local conditions as to whether a light pattern is actually located on the road surface or extends beyond it. In principle, the light pattern, in the sense used here, is defined by means of a projection onto a vertical surface in accordance with the relevant standards relating to motor vehicle lighting technology.

In order to meet this need, headlights have been developed that form a lighting matrix from a number of individual spotlights. Lighting devices of this type, also known as "pixel light", are commonly used in vehicle construction and serve, for example, to image a glare-free main beam, wherein the light is usually emitted by a plurality of light sources and is focussed in the direction of radiation by a corresponding plurality of light guides (lens systems/primary optics) arranged next to one another. The light guides have a relatively small, funnel-shaped cross-section and therefore emit the light of the individual light sources associated to them in a very concentrated manner in the direction of radiation. The light guides guide the light from the light sources to a position as close as possible on a spatially curved plane, the so-called Petzval plane of the upstream imaging optics.

Pixel headlights are very flexible in terms of light distribution, since the illumination intensity can be individually controlled for each pixel, i.e. for each light guide, and any light distribution can be implemented, such as a dipped beam light distribution, a cornering light distribution, a city light distribution, a motorway light distribution, a curve light distribution or a main beam light distribution.

AT 513 738 B1 describes headlight systems of the applicant, which project the light from a plurality of light-emitting diodes (LEDs) via projection systems with individual lenses onto the road surface as a light pattern, wherein the brightness of the individual LEDs, which are controlled from a central processing unit, can be individually adjusted and/or altered.

In addition to variable illumination intensity, the geometry of the light guide elements can be used to influence light patterns.

DE 10 412 213 845 A1 discloses an illumination device, which, in the case of motor vehicle headlights with primary optics, configures their light guide elements such that the intensity is varied in the longitudinal direction of the output surface. This is based on the assumption of similar light guide elements within the primary optics.

The number of light sources within the light matrix of a headlight determines the resolution of the light pattern and the degree of detail with which regions within a light distribution can either be selectively masked out or illuminated more or less strongly. For example, oncoming vehicles on a road can be specifically masked out so that their drivers are not dazzled, or traffic signs can be selectively illuminated more strongly so as to increase their legibility. Basically, within a light distribution, a higher resolution is usually required in the region in the middle of the light distribution, that is to say, in front of the vehicle, than at the edge of the light distribution, that is to say, at the edge of the road. Thus, the number of light sources often decreases from the centre to the edges. At the same time, the intensity maximum of the light distribution is usually pronounced in the centre of the light distribution, and the intensity decreases towards the edge. This means, for example, that the light-outcoupling surfaces, starting from the centre of an illumination series and extending to the edge, can be enlarged so as to take account of this desired reduction in brightness.

If a plurality of light sources and a plurality of primary optics are associated with one another and positioned relative to one another, an imprecise arrangement of the light sources on the circuit board, or of the primary optics in the holder, can adversely affect the incoupling of the emitted light into the primary optics.

An objective of the present invention is to increase the optical efficiency of motor vehicle headlight of the type cited above.

The object is achieved on the basis of a light module, that is to say, a motor vehicle headlight, of the type cited above, such that:

- the light sources, which each have a light-emitting surface and are arranged on a common circuit board,
- wherein a circuit board reference point and a light reference plane can be defined with respect to the circuit board, wherein the light reference plane is defined by at least three light reference points, and the circuit board reference point is preferably located in the light reference plane, and
- the primary optics of the plurality of primary optics each have a light-incoupling surface and a light-outcoupling surface, and are held in position by a common holder,
- wherein each light source from the plurality of light sources is associated with a respective primary optics from the plurality of primary optics,
- and each light source from the plurality of light sources is configured to emit light from the respective light-emitting surface, and to couple it into the respectively associated light-incoupling surface, and
- for the holder a holder reference point and an optics reference plane can be defined with respect to the holder, which optics reference plane is defined by at least three optics reference points, and in which the holder reference point is preferably also located,
- and at least three spacer devices are arranged between the circuit board, or a component, or a component assembly, with which the circuit board is mechanically fixedly connected, and the holder, or a component, or a component assembly, with which the holder is mechanically fixedly connected, respectively at the light reference points and the optics reference points,
- wherein the lengths and orientations of the at least three spacer devices in the light module are determined according to a transformation function, which describes the geometric transformation between the circuit board reference point and the holder reference point, and between a light reference plane and an optics reference plane, wherein a light plane is formed from the spatial position and/or orientation of the light-emitting surfaces of the light sources with respect to the light reference plane and the circuit board reference point, and an optics plane is formed from the spatial position and/or orientation of the light-incoupling surfaces of the primary optics with respect to the optics reference plane and the holder reference point, and the light plane is aligned with respect to the optics plane such that as much light as possible is emitted from light-emitting surfaces and is coupled into the respectively associated light-incoupling surface, and a separation triplet of grid point pairs is determined from the transformation function, which grid point pairs respectively extend between the light reference points and the optics reference points, and the at least three spacer devices implement the grid point pairs of the separation triplet with respect to magnitude and direction.

The light sources are arranged on the circuit board and are attached and electrically connected by means of solder at soldering points. In the course of the soldering process it may happen that the light sources, preferably semiconductor light sources, and, for example, in the form of light-emitting diodes, are displaced or spatially rotated with respect to a desired position or orientation relative to the reference point or the light reference plane of the circuit board, e.g. its surface. The light sources are electrically activated, wherein the electrical wiring is provided in the form of conductor tracks on the circuit board.

A deviation from the nominal position or nominal orientation with respect to the reference point or light reference plane of the circuit board, or with respect to the reference point or the optics reference plane of the holder, can occur in the course of the mounting of the light sources on the circuit board. The radiation vectors of the light sources often stand in a fixed relationship to the position of the light-emitting surface of the light sources, as determined by the design.

The light plane can be inclined by a spatial light angle with respect to the light reference plane. Similarly, the optics plane can be inclined by a spatial optics angle with respect to the optics reference plane.

Once the light plane has been determined from the light reference plane, or the optics plane from the optics reference plane, the respective relationship, hereinafter referred to as the offset, persists in the further course of adjustment and in the final arrangement of the motor vehicle headlight. Thus, the further considerations with respect to the distances in and transverse to the planes/reference planes, and the angular position with respect to one another apply likewise, but in each case with a respective offset.

In the arrangement of the motor vehicle headlight, the light reference plane and the optics reference plane are usually simple and easy to detect, for example in the form of the surface of the circuit board or of the holder, and therefore reference is made to the light and optics reference planes, instead of to the determined light and optics planes.

Consequently, the following considerations can be applied equally to the light and optics planes, but the determined offset must also be taken into account. The light and optics planes are virtual planes, which can be formed, for example in the form of average values, by contours of a plurality of components, for example light sources or light entry surfaces of primary optics.

The offset can be determined by means of the calculated transformation function.

The circuit board can be mounted on a heat sink, which is connected to an additional holder or a support frame, for example. The heat sink and the additional holder form a component assembly, with which the circuit board is mechanically fixedly connected. In this case, the three spacer devices rest on the additional holder of the component assembly, and connect the circuit board to the holder.

A component, or a component assembly, to which the circuit board is attached, may have a component reference point. The component reference point lies in a fixed, known relationship to the circuit board reference point. The component reference point can therefore also be used as a reference point for purposes of adjustment, and can be used, for example, as an alternative to the circuit board reference point.

The arrangement according to the invention ensures that the efficiency of the coupling of emitted light into the primary optics is improved in a simple and cost-effective manner.

A high efficiency of the coupling of light into an optical system is understood to mean that as much as possible of the light emitted by a light source is transferred into an optical system, that is to say, as little of the light emitted as possible, for example as a result of reflection losses at the media boundaries between the light source and the transmission medium, in this example air, or the transmission medium and the optical system, for example a light entry surface of the optical system, is unavailable for further intended subsequent optical use, or is lost due to inadequate alignment of the optical system with the light source.

In accordance with the invention, by means of an adjustment of the light plane with respect to the optics plane, taking into account reference points on the circuit board and the holder, it is possible to improve both the positions and also the orientations of the light sources with respect to the associated primary optics as a whole, that is to say, over the totality of the plurality of light sources and the totality of the plurality of primary optics. This allows the coupling of light from the light sources into the primary optics as a whole to be increased.

In the context of this invention, a light incoupling surface is understood to be a first end face of an optical light guide, which is oriented essentially normal to the path of longitudinal propagation in the light guide, and into which light can be coupled; this light is guided by the optical light guide to a second end face opposite the first end face with as little loss as possible, and is uncoupled from the light guide and emitted via the second end face, which is referred to as the light uncoupling surface.

The light-incoupling surface can, for example, have a plane, convex or concave shape, so as to be matched to a specific light source, and to enable the highest possible coupling of light emitted by the light source into the light guide. An incoupling vector describes that direction in space from which maximum light is coupled into the light guide. Needless to say, light can also be incoupled from other directions, but higher optical losses may occur, for example as a result of reflection at the surface of the light-incoupling surface, or longer optical paths of the incoupled light through the optical medium of the light guide.

The angular dependence of the intensity of received or transmitted light energy, usually related to a main direction, is called the radiation characteristic or reception characteristic. If the radiation or reception characteristic is not uniform over the solid angle, this is referred to as non-isotropic, and a directivity is present.

Light-incoupling surfaces of light guides often have non-isotropic reception characteristics. For a light-incoupling surface of the light guide, the direction of the maximum of the receiving characteristic can be specified by means of an incoupling vector, wherein the direction of the incoupling vector is directed towards the light-incoupling surface.

Light-emitting diodes often have non-isotropic radiation characteristics. For a light-emitting surface of the light-emitting diode, the direction of the maximum of the radiation characteristic can be indicated by means of a radiation vector, wherein the direction of the radiation vector is directed away from the light-emitting surface.

A distance dimension normal to the light reference plane and the optics reference plane, which are parallel to each other in the non-aligned state, can preferably be determined between the light-emitting surface of the respective light source from the plurality of light sources, and the light-incoupling surface of the respectively associated primary optics from the plurality of primary optics.

The distance dimensions are determined before adjustment, and are therefore specified with respect to the respective reference plane. The adjustment sets distances between the respective light sources and primary optics with respect to the light or optics planes, which distances are greater than zero in the adjusted state.

This ensures that the optical components: the light sources and the primary optics, do not touch each other, which fact can be used, for example, to achieve thermal decoupling between the two components. This extends the service life of the components.

Particularly preferably a distance-of-planes can be derived from the distance dimensions by means of the transformation function, which describes the distance between the circuit board and the holder in the circuit board reference point of the circuit board, or in the holder reference point of the holder, wherein the distance-of-planes is preferably determined such that a predetermined minimum separation is set for all distance dimensions.

The transformation function determines the physical distance between the circuit board and the holder, which is adjusted in the joint arrangement by spacer devices. Implicitly, however, an improved alignment of the light sources to the associated primary optics is carried out, and thus an improved efficiency of the coupling of emitted light into the primary optics. At the same time, a minimum distance is set, so as to reduce or prevent undesirable mechanical or thermal influences on the arrangement during operation in a motor vehicle headlight.

This ensures that the optical components: the light sources and the primary optics, do not touch each other, which fact can be used, for example, to achieve mechanical decoupling between two optical components. This can extend the service life of the components of the headlight, or can preserve the optical properties of the components. At the same time, the plane spacing is set to be as small as possible, so as to ensure the best possible efficiency for the coupling of the light emitted by the light sources into the primary optics.

It is beneficial if, starting from a light emitted by the light-emitting surface of the respective light source from the plurality of light sources, preferably in the direction of a radiation vector, and from a light coupled into the light-incoupling surface of the respective primary optics from the plurality of primary optics, preferably in the direction of an incoupling vector, a respective orientation measure can be defined for each pair of light source and associated primary optics, preferably from the spatial angular difference between the radiation vector and the incoupling vector.

This will achieve a good optical coupling between the two components, which leads to an improved optical efficiency.

In a further development of the invention, a plane displacement and/or a plane inclination about at least one axis of the light reference plane and/or the optics reference plane can be defined between the light reference plane and the optics reference plane with respect to the circuit board reference point and the holder reference point, in which the respective orientation measures are minimized, and the respective orientation measures of at least 75% of all pairs of light source and associated primary optics are preferably minimized.

In other words, the planes of the light plane and the optics plane can be displaced with respect to the circuit board reference point and the holder reference point with respect to one another, for example in an x/y plane. Alternatively or additionally, these two planes can be rotated around at least one axis of the light plane and/or the optics plane. To determine a plane displacement or inclination, the orientation measure can be used, which makes it particularly easy to determine a misalignment of the optical components: the light sources and the primary optics, with respect to one another.

The transformation function can determine the plane displacement so that the respective orientation measures are minimized and the respective orientation measures of at least 75% of all pairs of light source and associated primary optics are preferably minimized. This will ensure a particularly simple determination of the misalignment of the optical components: the light sources and the primary optics, with respect to one another.

The positions of the light-emitting surfaces of the light sources preferably lie approximately in the light plane, and/or the positions of the light-incoupling surfaces of the primary optics preferably lie approximately in the optics plane, wherein the approximation of the planes preferably takes place by respectively determining a best-fit plane.

In this context, approximation is understood to mean that a plane is defined by a plurality of points distributed in space, where the plane is to represent the plurality of points. Here a best-fit plane is a mathematically well-known term for the person skilled in the art.

The direction of the spacer devices preferably runs normal to the optics reference plane.

It is beneficial if the spacer devices are realized as respective adapter plates, preferably arranged between the holder and the circuit board, wherein in each case further a connector device is provided, preferably in the form of a screw, and the connector device fixedly connect the holder to the circuit board, preferably via an additional holder and a heat sink fixedly connected to the latter.

It is also beneficial if the spacer devices are constructed as spacer devices that preferably are realized as respective adapter plates, preferably arranged between the holder and an additional holder, and additionally having an adjustable connector device, preferably in the form of a screw, and an elastic mounting clip, wherein the mounting clip connects the holder to the circuit board, preferably via an additional holder and a heat sink fixedly connected to the latter. The additional holder serves as a mechanical adapter between two components.

It is advantageous if the spacer devices are constructed as spacer devices preferably realized as adapter plates, preferably arranged between the holder and the additional holder, and further having respective adjustable connector devices, preferably in the form of an adhesive, wherein the adhesive connects the holder to the circuit board, preferably via an additional holder and a heat sink fixedly connected to the latter.

It is particularly advantageous if the spacer devices have adjustable connector devices, preferably in the form of screws, and elastic mounting clips, wherein the mounting clip connects the holder to the circuit board, preferably via an additional holder and a heat sink fixedly connected to the latter, and the connector devices fixedly connect the mounting clips to the additional holder, and the connector devices fixedly connect the mounting clips to the holder.

It is also beneficial if the spacer devices, which are preferably formed integrally with the holder, have connector devices, preferably in the form of screws, wherein the connector devices fixedly connect the holder to the circuit board, preferably via an additional holder with a bearing surface and a heat sink fixedly connected to the additional holder, wherein the holder or the additional holder is adapted in shape, in particular to the position or orientation of the bearing surface or a corresponding bearing surface of the holder, so as to achieve an optimum height for the spacer devices, and the additional holder preferably further comprises a centring dome which interacts with a corresponding centring opening on the holder so as to achieve a desired alignment between the holder and the circuit board.

The inventive object is also achieved by a method of the type cited above, wherein:

the light sources from the plurality of light sources each have a light-emitting surface and are arranged on a common circuit board, and for the circuit board a circuit board reference point and a light reference plane can be defined with respect to the circuit board, wherein the light reference plane is defined by at least three light reference points, and the circuit board reference point is preferably located in the light reference plane, and the primary optics from the plurality of primary optics each have a light-incoupling surface and a light-outcoupling surface, and are held in position by a common holder, wherein each light source from the plurality of light sources is associated with a respective primary optics from the plurality of primary optics, and each light source from the plurality of light sources is arranged to emit light from the respective light-emitting surface, and to couple it into the respectively associated light-incoupling surface, and for the holder a holder reference point and an optics reference plane can be defined with respect to the holder, which optics reference plane is defined by at least three optics reference points, and in which the holder reference point is preferably also located, and at least three spacer devices are arranged, between the circuit board, or a component or a component assembly, with which the circuit board is mechanically fixedly connected, and the holder, or a component or a component assembly, with which the holder is mechanically fixedly connected, respectively at the light reference points and the optics reference points, wherein the lengths and orientations of the at least three spacer devices in the light module are determined according to a transformation function, which describes the geometric transformation between the circuit board reference point and the holder reference point, and between a light reference plane and an optics reference plane, wherein a light plane is formed from the spatial position and/or orientation of the light-emitting surfaces of the light sources with respect to the light reference plane and the circuit board reference point, and an optics plane is formed from the spatial position and/or orientation of the light-incoupling surfaces of the primary optics with respect to the optics reference plane and the holder reference point, and the light plane is aligned with respect to the optics plane such that as much light as possible is emitted from light-emitting surfaces and is coupled into the respectively associated light-incoupling surface, and a separation triplet of grid point pairs is determined from the transformation function, which grid point pairs respectively extend between the light reference points and the optics reference points, and the at least three spacer devices implement the grid point pairs of the separation triplet with respect to magnitude and direction.

In the method the following steps are executed:

detecting the spatial position and/or orientation of the light-emitting surfaces of the light sources from the plurality of light sources with respect to the light reference plane and the circuit board reference point using a measuring device, calculating a light plane from the spatial positions and/or orientations of the detected light-emitting surfaces of the light sources from the plurality of light sources using a computing device comprised in the measuring device, detecting the spatial position and/or orientation of the light-incoupling surfaces of the primary optics from the plurality of primary optics with respect to the optics reference plane and the holder reference point using the measuring device, calculating an optics plane from the detected spatial positions and/or orientations of the light-incoupling surfaces of the primary optics from the plurality of primary optics using the computing device, calculating the transformation function using the computing device, determining a separation triplet of grid point pairs from the transformation function using the computing device, arranging at least three spacer devices between the circuit board, or a component or a component assembly to which the circuit board is mechanically fixed, and the holder, at the light reference points and the optics reference points, aligning the holder in the light or optics plane according to the respective reference points, fixing the holder by means of at least one connecting means.

The inventive method ensures that the efficiency of the coupling of emitted light into the primary optics is improved in a simple and cost-effective manner.

Screws or adhesive can serve as the connecting means, for example.

If screws are used as the connecting means, they can be aligned in the light or optics plane by means of openings provided in the holder, of an appropriately large size to accommodate the screws.

A preferred further development of the method consists in the fact that between the light-emitting surface of the respective light source from the plurality of light sources and the light-incoupling surface of the respectively associated primary optics from the plurality of primary optics, a distance dimension normal to the light reference plane and the optics reference plane, which in the non-adjusted state run parallel to one another, is determined by means of the computing device.

It is advantageous if a distance-of-planes is determined from the distance dimensions by the transformation function, which describes the distance between the circuit board and the holder in the circuit board reference point of the circuit board, or in the holder reference point of the holder, wherein the distance-of-planes is preferably determined such that a predetermined minimum separation is set for all distance dimensions.

It is beneficial if the respective light source from the plurality of light sources is configured to emit light from the light-emitting surface, preferably in the direction of an emission vector, and to couple it into the light-incoupling surface of the respectively associated primary optics from the plurality of primary optics, preferably from the direction of an input vector, and for each pair of light source and associated primary optics a respective orientation measure is determined by means of the computing device, which corresponds to the input of the respectively emitted light and the respectively incoupled light, and which is preferably determined from the spatial angle difference between the radiation vector and the incoupling vector.

Moreover it is beneficial if a plane displacement between the light reference plane and the optics reference plane with respect to the circuit board reference point and the holder reference point and/or a plane inclination, around at least one axis of the light reference plane and/or the optics reference plane is achieved, preferably from the respective orientation measure, so that the respective orientation measures are minimized, and the respective orientation measures of at least 75% of all pairs of light source and associated primary optics are preferably minimized.

The orientation measures are determined before adjustment and are therefore specified with respect to the respective reference plane. The adjustment procedure is used to set orientations between the respective light sources and primary optics with respect to the light and optics planes.

This ensures that in the adjusted state the light plane and the optics plane are parallel to each other and also have a minimum separation. The minimum separation is the smallest distance that must be maintained, for example by virtue of mechanical or thermal requirements, for the arrangement of light sources and primary optics relative to one another in order to enable reliable operation in a motor vehicle headlight.

It is preferable if the positions of the light-emitting surfaces of the light sources are located approximately in the light plane, and/or the positions of the light-incoupling surfaces of the primary optics are located approximately in the optics plane, wherein the approximation of the planes preferably takes place by respectively determining a best fit plane.

It is particularly preferable if the direction of the spacer devices runs normal to the optics reference plane.

By means of the further developments of the inventive method the advantages of the inventive device are also achieved.

It is clear to the person skilled in the art that a light module or a motor vehicle headlight for a motor vehicle, such as in particular a car or a motorcycle, contains many other parts that have not been mentioned, such as cooling devices for components, control electronics, other optical elements, mechanical adjustment devices and mountings. It is also clear that a light module is part of a motor vehicle headlight.

The invention and other advantages are described in more detail below on the basis of non-restrictive examples of embodiment, which are illustrated in the accompanying figures. In the figures:

FIG. 1 shows a first example of embodiment of an inventive motor vehicle headlight in a longitudinal sectional view, FIG. 2 shows a plan view onto a holder with primary optics of the headlight in FIG. 1

FIG. 3 shows a schematic side view of the headlight in FIG. 1 in a first assembly position, FIG. 4 shows a schematic side view of the headlight in FIG. 1 in a second assembly position, FIG. 5 shows an exposition of the principal structure of the headlight in FIG. 1 in a perspective view, FIG. 6 shows a second example of embodiment of an inventive motor vehicle headlight in a longitudinal sectional view, FIG. 7 shows a third example of embodiment of an inventive motor vehicle headlight in a longitudinal sectional view, FIG. 8 shows a fourth example of embodiment of an inventive motor vehicle headlight in a longitudinal sectional view, FIG. 9 shows a fifth example of embodiment of an inventive motor vehicle headlight in a longitudinal sectional view, FIG. 10 shows a plan view onto a holder with primary optics of the headlight in FIG. 9, FIG. 11 shows a flow chart of an example of embodiment of an inventive method, FIG. 12 shows an illustration of the step in the method for the detection of the spatial position and/or orientation of the light-incoupling surfaces of the primary optics from FIG. 11, FIG. 13 shows an illustration of the step in the method for the detection of the spatial position and/or orientation of the light-emitting surfaces of the light sources from FIG. 11, The figures show parts that are important for the invention in a headlight, wherein it is evident that a headlight contains many other parts that are not shown, and that enable useful deployment in a motor vehicle, such as, in particular, a car or a motorcycle. For the sake of clarity, for example, the housing, control electronics, other optical elements such as projection optics, mechanical adjustment devices or mountings are therefore not shown. The motor vehicle headlights of the figures are therefore depicted in a highly simplified manner, and can also be regarded as light modules of a motor vehicle headlight, for example.

FIGS. 1 to 5 illustrate a first example of embodiment of the invention with a motor vehicle headlight 1, comprising a plurality of light sources 110, 120, 130 and a plurality of primary optics 210, 220, 230.

FIG. 1 shows a section through the motor vehicle headlight 1 in a side view.

The set of light sources 110, 120, 130 is also identified by the reference symbol 100.

The light sources 110, 120, 130 respectively have light-emitting surfaces 111, 121, 131, and are arranged on a common circuit board 50.

For the circuit board 50 a circuit board reference point 51 and a light reference plane 10 can be defined with respect to the circuit board 50. The light reference plane 10 is defined by at least three light reference points 11, 12, 13, and the circuit board reference point 51 is located in the light reference plane 10.

It is clear that a component or a component assembly, to which the circuit board 50 is attached, may also have a component reference point. The component reference point lies in a fixed, known relationship to the circuit board reference point 51, and therefore the component reference point can also be used as a reference point for purposes of adjustment, and can be used, for example, as an alternative to the circuit board reference point 51. Such a component assembly may include, for example, a heat sink 90, an additional holder 65, a support frame, or the like.

For the sake of clarity, only the reference point 51 and light sources are shown in the figures, but no conductor paths are indicated on the circuit board 50.

Figure 3:
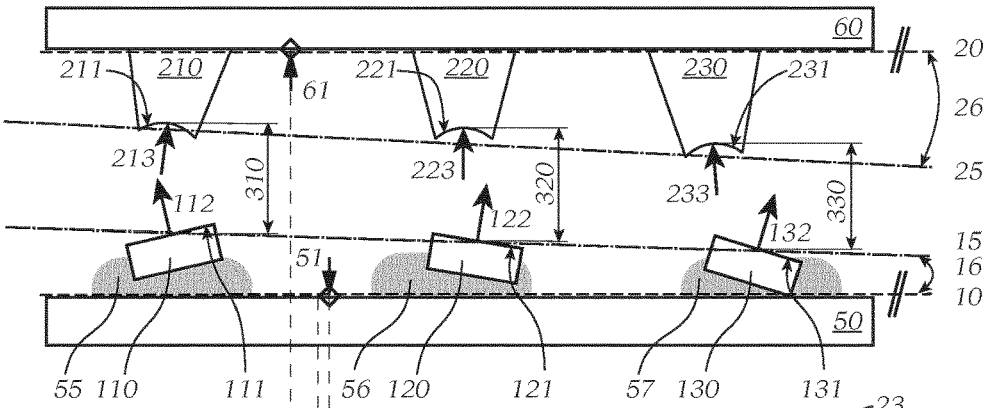
FIG. 3 shows an arrangement in a first assembly position in a non-adjusted state, that is to say, before an adjustment according to the invention.
Figure 4:
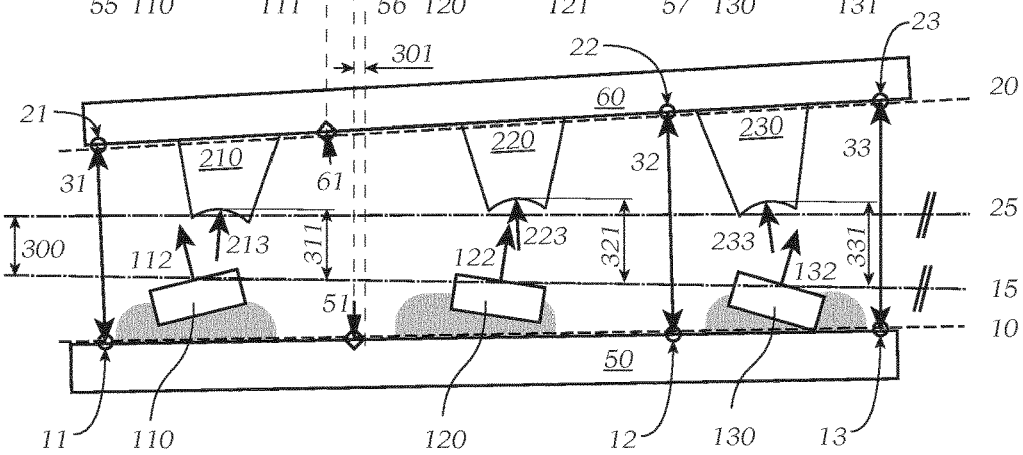
FIG. 4 shows the arrangement of FIG. 3 in a second assembly position in an adjusted state, that is to say, after an adjustment according to the invention.
Figure 5:
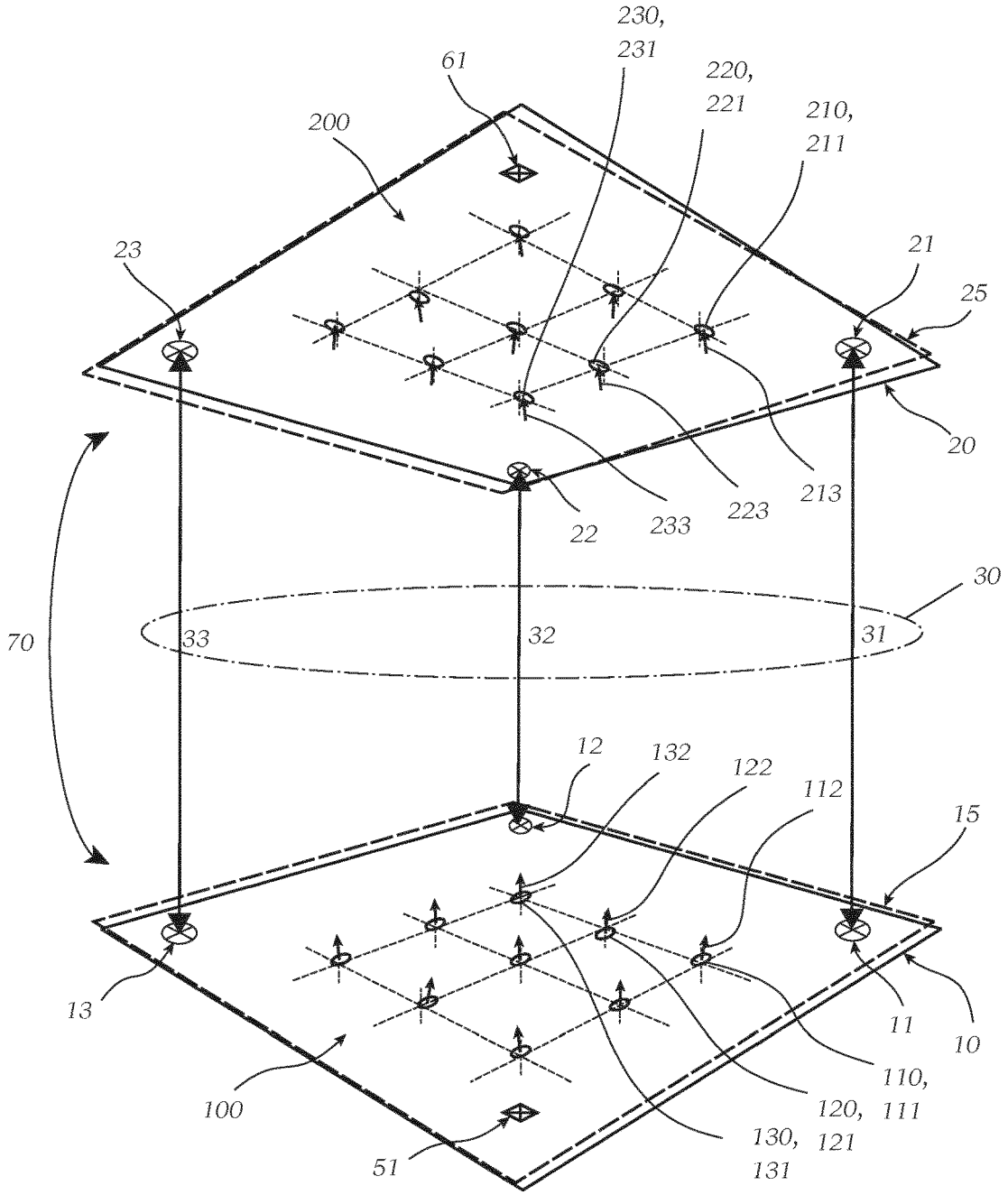

FIG. 3 and FIG. 4 show exemplary arrangements of the light sources 110, 120, 130, which are arranged on the circuit board 50 and are attached and electrically connected by means of solder at soldering points 55, 56, 57. In the course of the soldering process it can happen that the light sources 110, 120, 130, preferably semiconductor light sources and, for example, in the form of light-emitting diodes, are displaced or spatially rotated with respect to a nominal position or a nominal orientation with respect to the reference point 51 or the light reference plane 10 of the circuit board 50, for example its surface. In particular, the positions of the light-emitting diodes can also differ in terms of the height in the z-direction, for example as a result of different amounts of solder being applied, as a result of which the light-emitting surfaces 111, 121, 131 can have different positions. In FIG. 4 and FIG. 5 the rotations are shown in a highly exaggerated manner for illustrative purposes. The light sources 110, 120, 130 are electrically activated, wherein the electrical wiring (not shown) is provided in the form of conductor tracks on the circuit board 50.

The primary optics 210, 220, 230 respectively have light-incoupling surfaces 211, 221, 231 and light-outcoupling surfaces 212, 222, 232, and are held in position by a common holder 60.

Each light source 110, 120, 130 is respectively associated with primary optics 210,220,230.

The set of primary optics 210, 220, 230 is also designated by the reference symbol 200.

Figure 2:
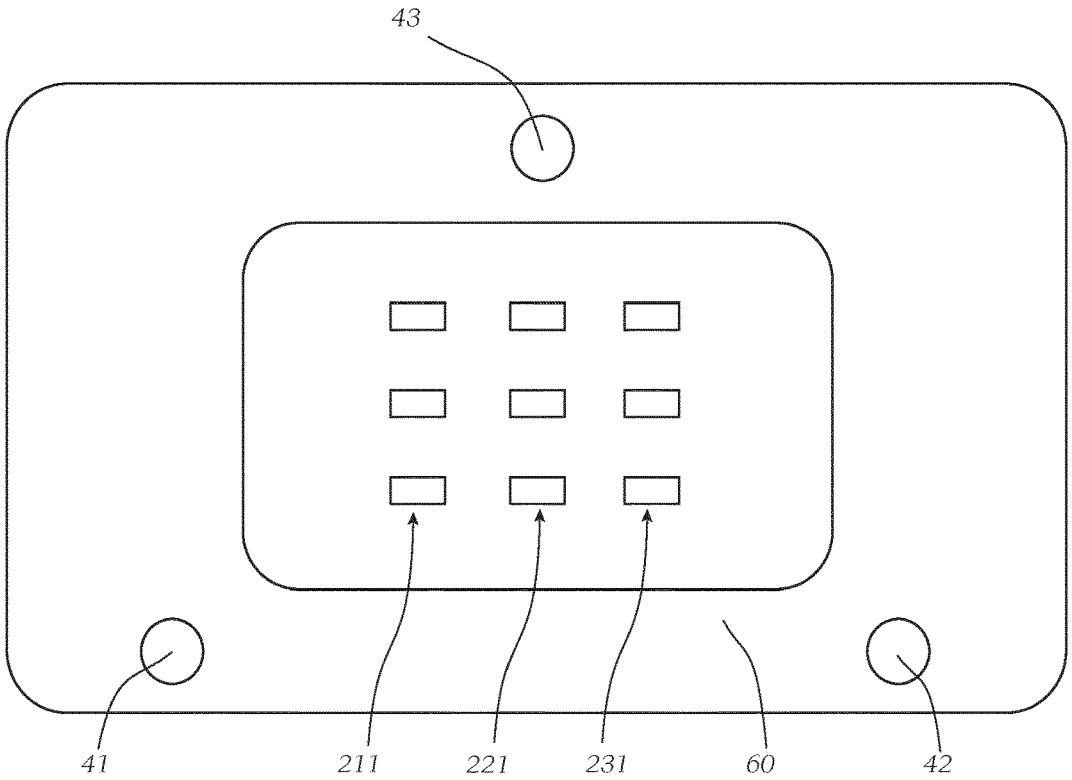

A central part of this arrangement, the holder 60, is shown in a view onto the light-incoupling surfaces 211, 221, 231 in FIG. 2. In addition, spacer devices 41, 42, 43 can be seen, which are arranged on the holder 60.

Each light source 110, 120, 130 is configured to emit light from the respective light-emitting surface 111, 121, 131, and to couple it into the respectively associated light-incoupling surface 211, 221, 231.

For the holder 60, a holder reference point 61 and an optics reference plane 20 can be defined with respect to the holder 60, which optics reference plane 20 is defined by at least three optics reference points 21, 22, 23, and in which plane the holder reference point 61 is also located.

FIG. 3 and FIG. 4 show, by means of examples, primary optics 210, 220, 230, which are displaced or spatially rotated in position and orientation, in relation to a nominal position or a nominal orientation, in relation to the reference point 61 or the optics reference plane 20 of the holder 60, for example its surface, which displacement or rotation may be caused by inaccuracies and tolerances in the manufacture of the holder 60 or the primary optics 210, 220, 230. In FIG. 3 and FIG. 4 the rotations are shown in a highly exaggerated manner for illustrative purposes.

At least three spacer devices 41, 42, 43 are arranged between a component assembly, comprising the circuit board 50 and the additional holder 65, and the holder 60, at the light reference points 11, 12, 13 and the optics reference points 21, 22, 23 respectively.

The circuit board 50 is mounted on a heat sink 90, which is connected to an additional holder 65. The heat sink 90 and the additional holder 65 form a component assembly, to which the circuit board 50 is mechanically fixedly connected. The lengths and orientations of the at least three spacer devices 41, 42, 43 are determined according to a transformation function 70, which describes the geometrical transformation between the circuit board reference point 51 and the holder reference point 61, and between a light reference plane 10 and an optics reference plane 20.

In other words, the transformation function 70 describes a geometrical interrelationship between the light reference plane 10 and the optics reference plane 20. It is not a physical feature, but rather a mathematical quantity.

A light plane 15 is formed from the spatial position and/or orientation of the light-emitting surfaces 111, 121, 131 of the light sources 110, 120, 130 with respect to the light reference plane 10 and the circuit board reference point 51.

An optics plane 25 is formed from the spatial position and/or orientation of the light-incoupling surfaces 211, 221, 231 of the primary optics 210, 220, 230 with respect to the optics reference plane 20 and the holder reference point 61.

The light plane 15 is aligned with respect to the optics plane 25 such that as much light as possible is emitted from the light-emitting surfaces 111, 121, 131 and coupled into the respectively associated light-incoupling surfaces 211, 221, 231.

From the transformation function 70 a separation triplet 30 of grid point pairs 31, 32, 33 can be defined, which run between the light reference points 11, 12, 13 and the optics reference points 21, 22, 23.

The at least three spacer devices 41, 42, 43 implement the grid point pairs 31, 32, 33 of the separation triplet 30 with respect to magnitude and direction.

The holder 60 has a holder reference point 61 and an optics reference plane 20 on the holder 60. The optics reference plane 20 is defined by at least three optics reference points 21, 22, 23, in which plane the holder reference point 61 is also located.

It can be seen in FIG. 4 that in the adjusted state the light plane 15 is parallel to the optics plane 25.

FIG. 5 schematically shows the arrangement of the light sources 110, 120, 130 with their respective radiation vectors 112, 122, 132, and the primary optics 210, 220, 230 with their respective light-incoupling surfaces 211, 221, 231, which have a deviation from the nominal position or nominal orientation relative to the circuit board reference point 51 and/or the light reference plane 10 of the circuit board 50, and relative to the holder reference point 61 and/or the optics reference plane 20 of the holder 60. The radiation vectors 112, 122, 132 are usually in a fixed relationship with the position and orientation of the light-emitting surface 111, 121, 131 of the light sources 110, 120, 130, as determined by the design.

The light plane 15 is inclined by a spatial light angle 16 with respect to the light reference plane 10.

The optics plane 25 is inclined by a spatial optics angle 26 with respect to the optics reference plane 20.

The transformation function 70 can describe, in particular, a displacement of the circuit board reference point 51 with respect to the holder reference point 61 transverse to the light reference plane 10 or the optics reference plane 20, together with a spatial rotation of these two planes 10, 20 through the angles 16, 26. Thus, initial coupling distances 310, 320, 330 can be transformed to reduced coupling distances 311, 321, 331, wherein a minimum coupling distance can be maintained so as not to establish a direct mechanical contact between a light source and a primary optics, which could otherwise be disadvantageous in difficult ambient conditions during the operation of the motor vehicle headlight 1.

It is clear that the transformation function 70 can describe both the case of a displacement in one direction and also that in a plurality of directions. It is also clear that the transformation function 70 can describe the case of a rotation about one axis, and also that about a plurality of axes. It is furthermore clear to the person skilled in the art that in general the transformation function 70 can describe combinations of one or a plurality of displacements and one or a plurality of rotations.

The separation triplet 30 of grid point pairs 31, 32, 33 is symbolically represented in FIG. 5 by double arrows, which are mapped by the transformation function 70, and describe a pair-wise association of the positions of the grid points in the light reference points 11, 12, 13 with the grid points in the optics reference points 21, 22, 23.

The inventive arrangement ensures that the efficiency of the coupling of emitted light into the primary optics is improved in a simple and cost-effective manner.

Preferably, at least three distance dimensions 310, 320, 330 normal to the light reference plane 10 and the optics reference plane 20 are defined between the light-emitting surface 111, 121, 131 of the respective light sources 110, 120, 130, and the light-incoupling surface 211, 221, 231 of the respective primary optics 210, 220, 230, which in the non-adjusted state run parallel to each other. This ensures that the optical components: the light sources 110, 120, 130, and the primary optics 210, 220, 230, do not touch each other, which can be used, for example, to achieve a thermal decoupling between the two components. This can benefit the service life of the components.

A distance-of-planes 300 can particularly preferably be determined from the distance dimensions 310, 320, 330 with the aid of the transformation function 70, which describes the distance between the circuit board 50 and the holder 60 in the circuit board reference point 51 of the circuit board 50 or in the holder reference point 61 of the holder 60, wherein the distance-of-planes 300 is preferably determined such that a predetermined minimum separation is set for all distance dimensions 310, 320, 330. This ensures that the optical components: the light sources 110, 120, 130, and the primary optics 210, 220, 230, do not touch each other, which can be used, for example, to achieve a mechanical decoupling between two optical components. This improves the service life of the components.

Starting from a light emitted by the light-emitting surface 111, 121, 131, and from a light coupled into the light-incoupling surface 211, 221, 231, a respective orientation measure can be defined for each pair of light source 110, 120, 130 and associated primary optics 210, 220, 230.

For example, the emission occurs primarily in the direction of a radiation vector 112, 122, 132, and, for example, the incoupling occurs from the direction of an incoupling vector 213, 223, 233.

For each pair of light source 110, 120, 130 and associated primary optics 210, 220, 230, there is thus a respective orientation measure, which corresponds to the incoupling of the respectively emitted light and the respectively incoupled light, and which is preferably determined from the spatial angular difference between the radiation vector 112, 122, 132 and the incoupling vector 213, 223, 233. By means of a good optical coupling between the two components, an improved optical efficiency of the headlight can be achieved.

In a further development of the invention, the transformation function 70 can be determined with respect to a plane displacement 301 between the light reference plane 10 and the optics reference plane 20, with respect to the circuit board reference point 51 and the holder reference point 61. Alternatively or additionally, the transformation function 70 can be determined with respect to a plane inclination 16, 26 about at least one axis of the light reference plane 10 and/or the optics reference plane 20. This allows a particularly simple determination of the misalignment of the optical components: the light sources 110, 120, 130 and the primary optics 210, 220, 230, with respect to one another.

The transformation function 70 can determine the plane displacement 301 such that the respective orientation measures are minimized and the respective orientation measures of at least 75% of all pairs of light source 110, 120, 130 and associated primary optics 210, 220, 230 are preferably minimized. This makes it particularly easy to determine the misalignment of the optical components: the light sources 110, 120, 130 and the primary optics 210, 220, 230 with respect to one another.

The positions of the light-emitting surfaces 111, 121, 131 of the light sources 110, 120, 130 preferably lie approximately in the light plane 15, and/or the positions of the light-incoupling surfaces 211, 221, 231 of the primary optics 210, 220, 230 preferably lie approximately in the optics plane 25, wherein the approximation of the planes preferably takes place respectively by a determination of a best-fit plane.

In this context, approximation is understood to mean that a plane is defined by a plurality of points distributed in space, wherein the plane is to represent the plurality of points. The best-fit plane is executed in accordance with a mathematical fitting method of known art, such as the method of least squares.

There are many different options for the determination of an approximation to define a plane that lies approximately between individual points in space. For example, the average of the distances of the points to the plane, respectively measured normal to the plane, can be minimized. Alternatively, the plane can be determined, for example, by determining an average value for only a subset of the points. This subset may, for example, be defined as the points located centrally in the plane, wherein the centrally located points are intended to represent and correspond to the centrally located light components in a light distribution of a motor vehicle headlight.

On the other hand, the orientations of the radiation vectors of the light sources and the incoupling vectors of the primary optics can also be used to determine an approximation for purposes of defining the plane that lies approximately between individual points in space. The plane can be defined such that the radiation vectors of the light sources and the incoupling vectors of the primary optics are aligned with one another as well as possible, or such that this aspect coincides as well as possible for at least a subset of the vectors.

It is also possible to combine the distance-based approximation cited above with the vector-based approximation cited immediately above. With this approximation variant, particularly good results can be achieved with respect to light coupling by maintaining a specified minimum separation for all components (a plurality of light sources and a plurality of primary optics) by means of the determined position of the best-fit plane.

The approximation should respectively be determined for the whole system, that is to say, for the plurality of light sources and the plurality of primary optics. In the determination maxima and minima can, for example, be determined for the positions of individual light sources and/or primary optics, and from these the best-fit plane can be determined by an iterative process.

Furthermore, parameters from the determination of the transformation function can be used in combination in the determination of the respective best-fit plane.

In the example of embodiment shown, the direction of the spacer devices 41, 42, 43 runs normal to the optics reference plane 20.

Figure 1:
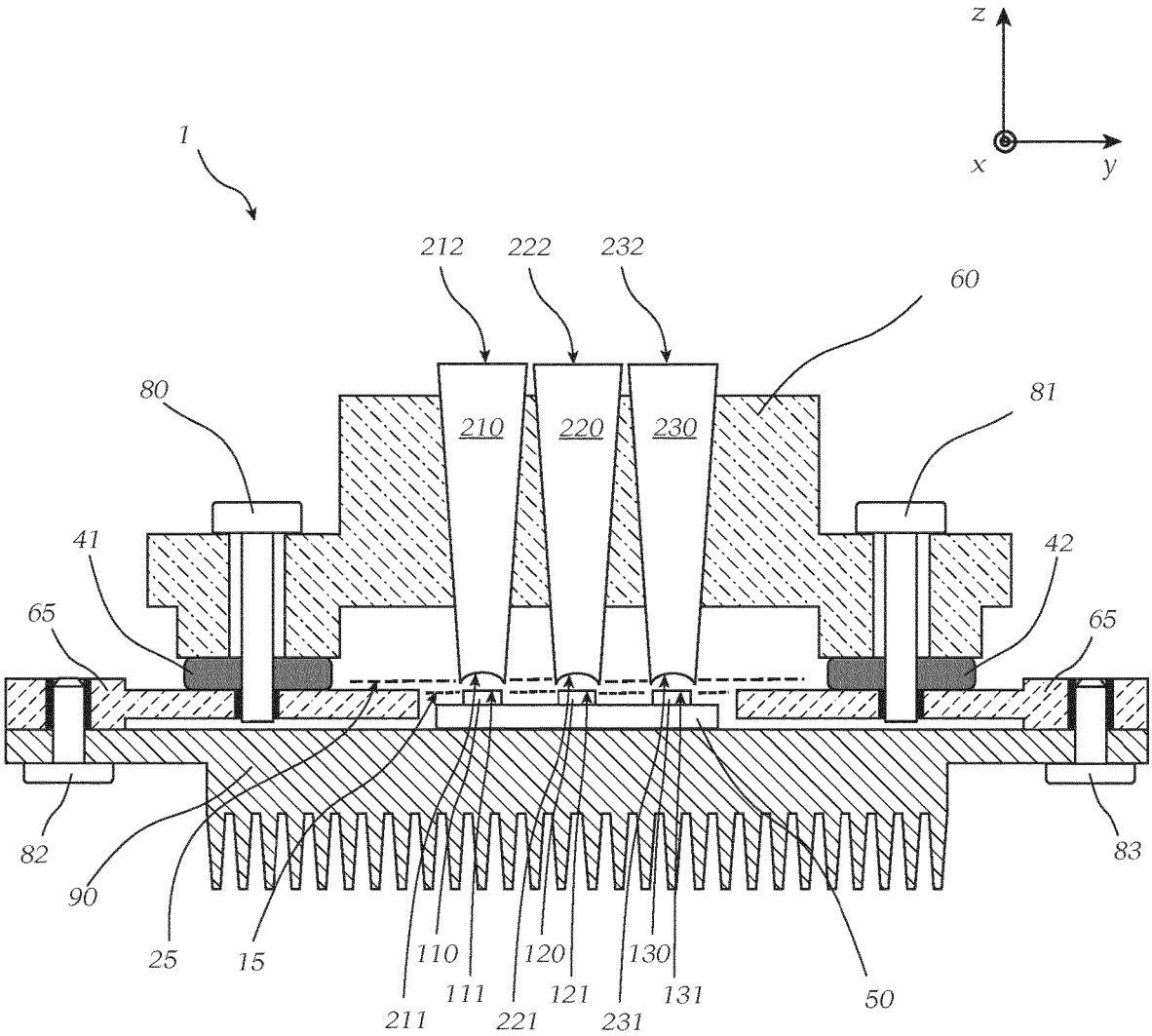

In the light module 1 of FIG. 1, the spacer devices 41, 42, 43 are each realized in the exemplary form of a spacer or adapter plate, which are preferably arranged between the holder 60 and a component assembly, comprising the additional holder 65, the heat sink 90, and the circuit board 50. One form of embodiment for the adapter plate is, for example, a washer with a desired height, or an adapter integrated in a holder in the form of a milled out region in the holder, such that a screw head, acting as a connector device, obtains a corresponding support at a desired height.

The spacer devices 41, 42, 43 have a respective height determined by means of the inventive method from the transformation function 70. By means of the height of the spacer devices 41, 42, 43 an adjustment triangle is stretched across at least three points; among other tasks, this triangle is used to align the light plane 15 with respect to the optical plane 25.

Additional connector devices 80, 81, preferably in the form of screws, are provided. The connector devices 80, 81 fixedly connect the holder 60 to the circuit board 50, preferably via an additional holder 65 and a heat sink 90 that is fixedly connected to the latter. The connector devices 80, 81 are designed to be inserted into reception points in the form of openings in both the holder 60 and the additional holder 65. Furthermore, the openings of the additional holder 65 are provided with respective threads, configured to receive the screws. The spacer devices 41, 42, 43, for example, are realized as washers with individually adapted heights, through which screws are led.

The positions of the spacer devices 41, 42, 43, that is to say, the connector devices 80, 81, together with the associated reception points in the form of openings, are determined by means of the inventive method from the transformation function 70. The positions of the spacer devices 41, 42, 43, that is to say, the connector devices 80, 81, together with the corresponding reception points, cause the adjustment triangle to be stretched across the at least three points cited above; this triangle is also used in the alignment of the circuit board reference point 51 with respect to the holder reference point 61.

The openings for receiving the connector devices 80, 81 in the holder 60 are larger in cross-section than the screws received therein, in order to allow a displacement in the direction of the light plane 15 with respect to the optics plane 25 during the adjustment process.

Figure 6:
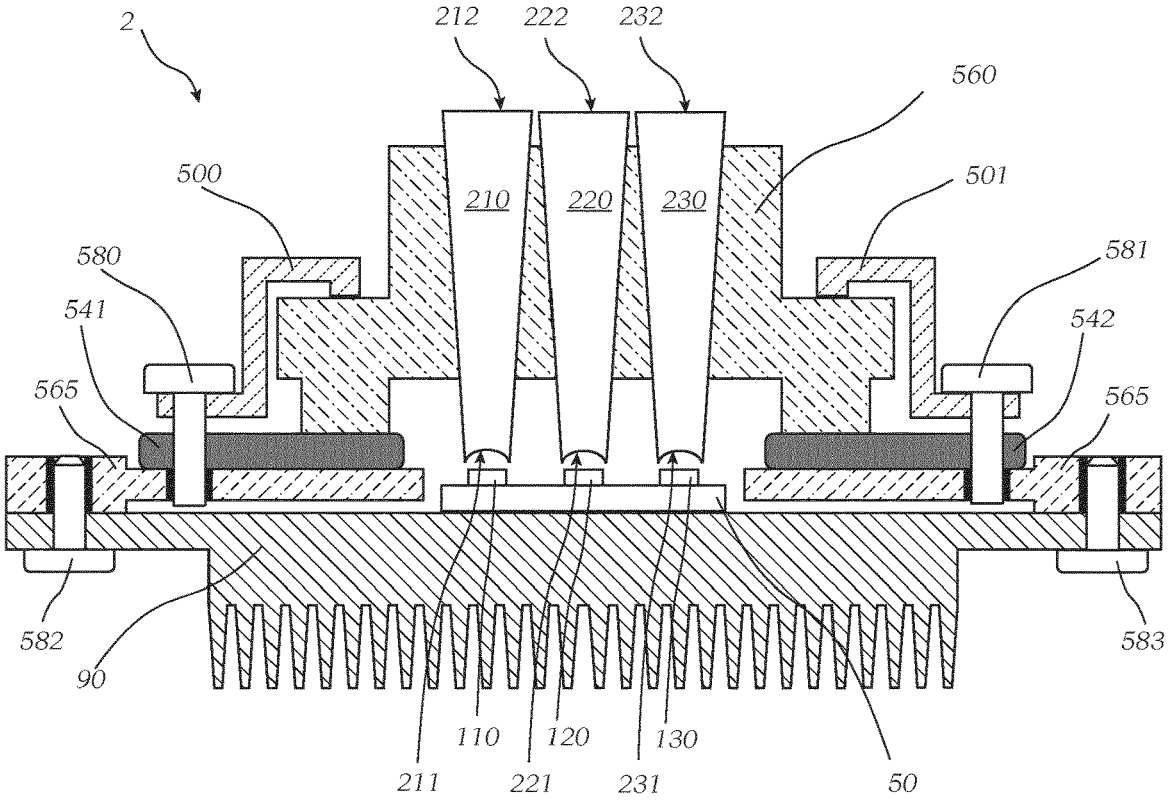

FIG. 6 shows a second example of embodiment of a motor vehicle headlight 2. The optical elements, such as the light sources 110, 120, 130 and the primary optics 210, 220, 230, correspond to those of the first example of embodiment. In contrast to FIG. 1, the at least three spacer devices 41, 42, 43 are respectively realized as spacer devices 541, 542 in the form of an adapter plate, which is preferably arranged between the holder 560 and an additional holder 565, and additionally have respective adjustable connector devices 580, 581, preferably in the form of a screw, and an elastic mounting clip 500, 501, wherein the mounting clip 500, 501 connects the holder 560 to the circuit board 50, preferably via an additional holder 565, and a heat sink 90 fixedly connected to the latter. The other embodiments correspond to those of the first example of embodiment.

In this example of embodiment, a first component assembly is formed by the circuit board 50, the heat sink 90, and the additional holder 565. A second component assembly is formed by the holder 560 and the mounting clips 500, 501.

Figure 7:
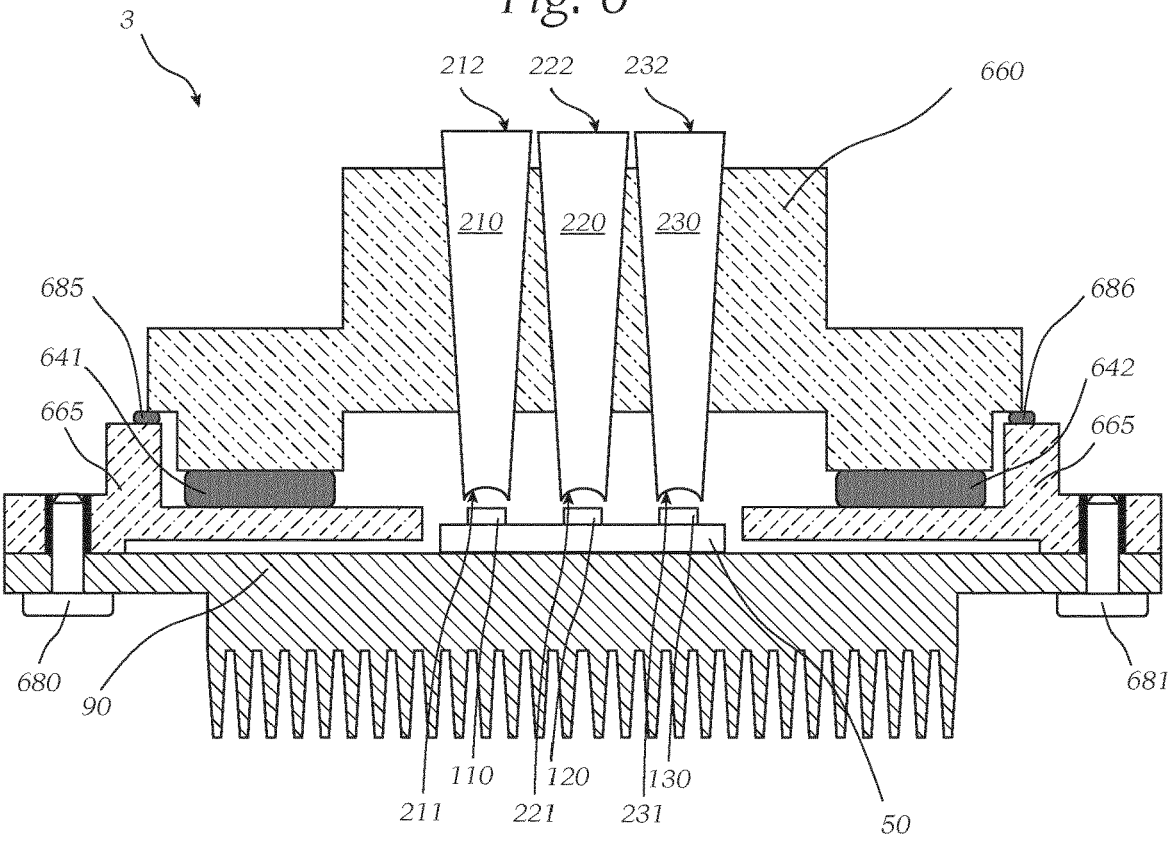

FIG. 7 shows a third example of embodiment of a motor vehicle headlight 3. The optical elements, such as the light sources 110,120, 130 and the primary optics 210, 220, 230, correspond to those in the first example of embodiment. In contrast to FIG. 1, the at least three spacer devices 41, 42, 43 are realized as spacer devices 641, 642 in the form of an adapter plate, which is preferably arranged between the holder 60, 560, 660, 760, 860 and the additional holder 665, and additionally have respective adjustable connector devices 685, preferably in the form of an adhesive, wherein the adhesive connects the holder 660 to the circuit board 50, preferably via an additional holder 665 and a heat sink 90 fixedly connected to the latter. The other embodiments correspond to those of the first example of embodiment.

Figure 8:
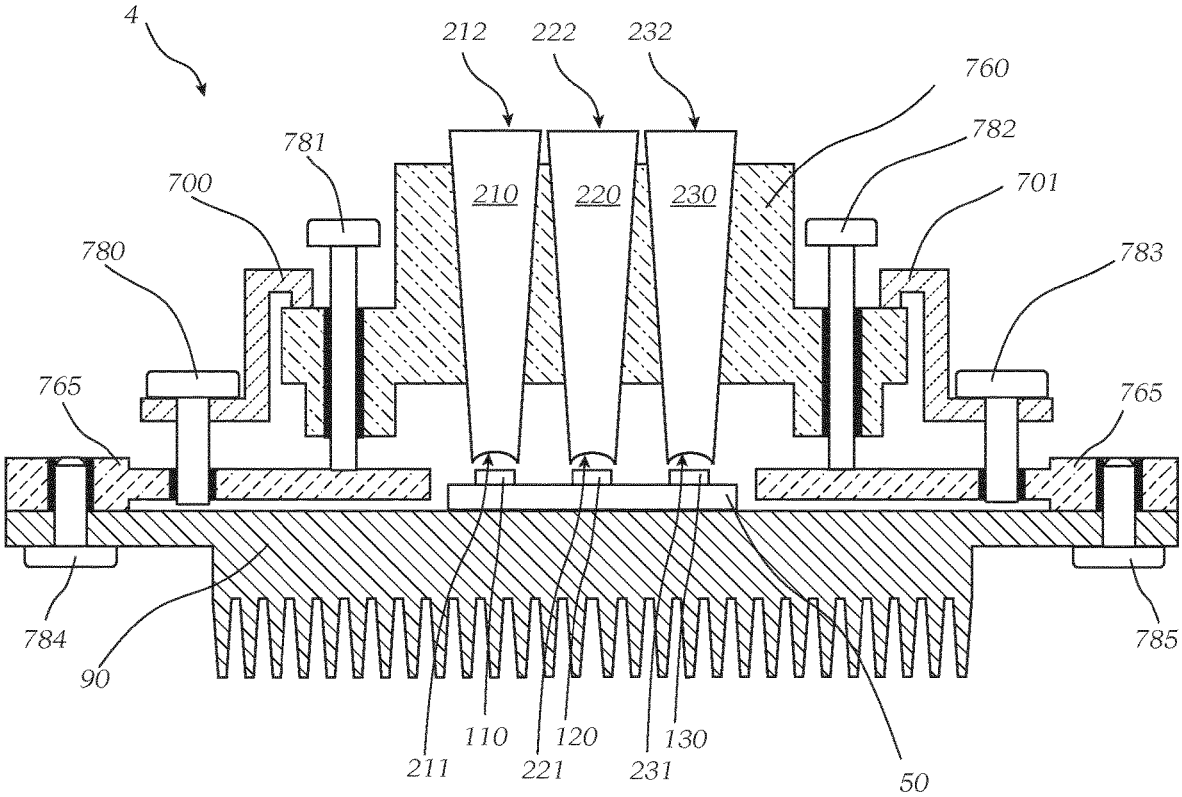

FIG. 8 shows a fourth example of embodiment of a motor vehicle headlight 4. The optical elements, such as the light sources 110,120, 130 and the primary optics 210, 220, 230, correspond to those of the first example of embodiment. In contrast to FIG. 1, the at least three spacer devices 41, 42, 43 have adjustable connector devices 780, 781, 782, 783, preferably in the form of screws, and elastic mounting clips 700, 701, wherein the mounting clips 700, 701 connect the holder 760 to the circuit board 50, preferably via an additional holder 565 and a heat sink 90 fixedly connected to the latter. The connector devices 780, 783 fixedly connect the mounting clips 700, to the additional holder 565, and the connector devices 781, 782 fixedly connect the mounting clips 700, 701 to the holder 760. The other embodiments correspond to those of the first example of embodiment.

In this example of embodiment, a first component assembly is formed by the circuit board 50, the heat sink 90, and the additional holder 765. A second component assembly is formed by the holder 760 and the mounting clips 700, 701.

Figure 9:
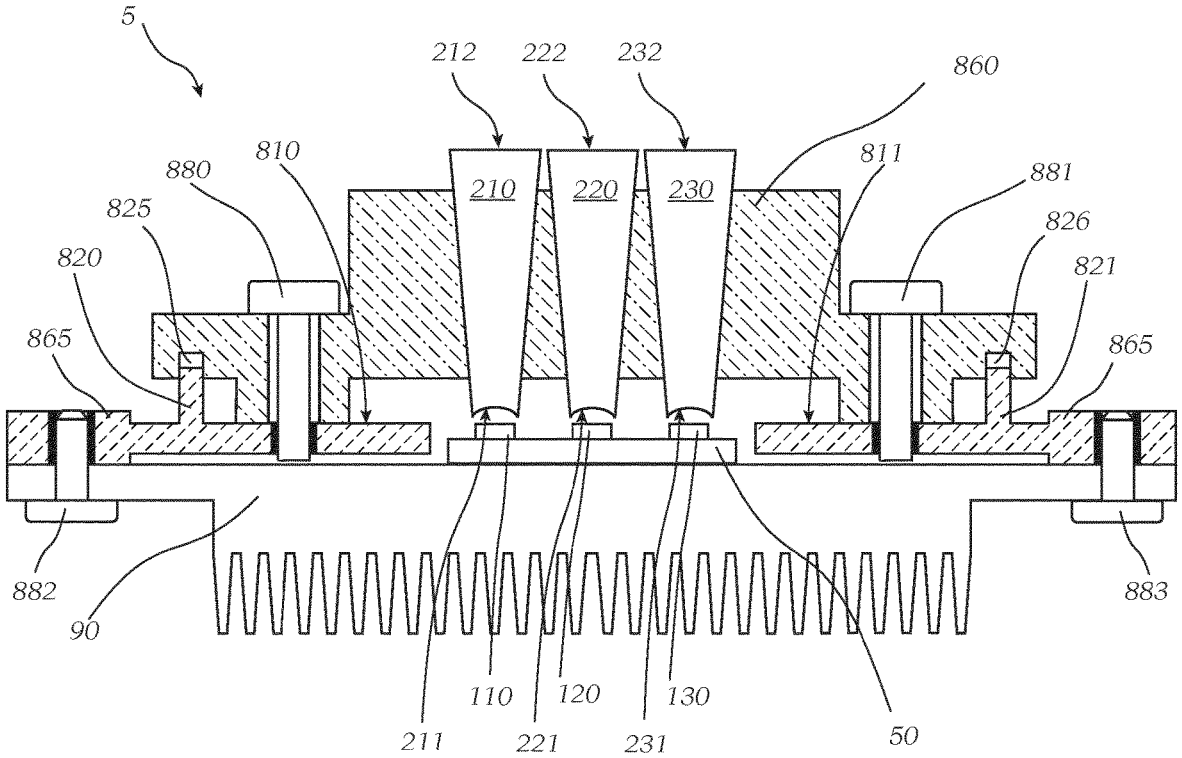

FIG. 9 shows a fifth example of embodiment of a motor vehicle headlight 5. The optical elements, such as the light sources 110,120, 130 and the primary optics 210,220,230 correspond to those of the first example of embodiment. In contrast to FIG. 1, the at least three spacer devices 41, 42, 43 have connecting means 880, 881 in the form of screws. The connector devices 880, 881 fixedly connect the holder 860 to the circuit board 50, preferably via an additional holder 865 with a bearing surface 810, 811, and a heat sink 90 fixedly connected to the additional holder 865.

In this example of embodiment, a component assembly is formed by the circuit board 50, the heat sink 90, and the additional holder 865.

The holder 860 or the additional holder 865 is adapted in shape, in particular to the position and orientation of the bearing surface 810, 811, such that an optimum height is achieved for the spacer devices 41, 42, 43.

The spacer devices 41, 42, 43 can be formed integrally with the holder 860.

This adaptation can be made by milling the bearing surface of the holder to the correct height according to the transformation function. In this example of embodiment, therefore, an additional spacer device is not necessary, and the spacer device is realized integral with the holder.

The additional holder 865 also has a centring dome 820, 821, which interacts with a corresponding centring opening 825, 826 on the holder 860, so as to achieve a desired alignment between the holder 860 and the circuit board 50.

For this purpose, the centring openings 825, 826 can be milled or drilled at the appropriate positions according to the transformation function, so as to ensure an optimal adjustment in the x-y plane.

The other embodiments correspond to those of the first example of embodiment.

Figure 10:
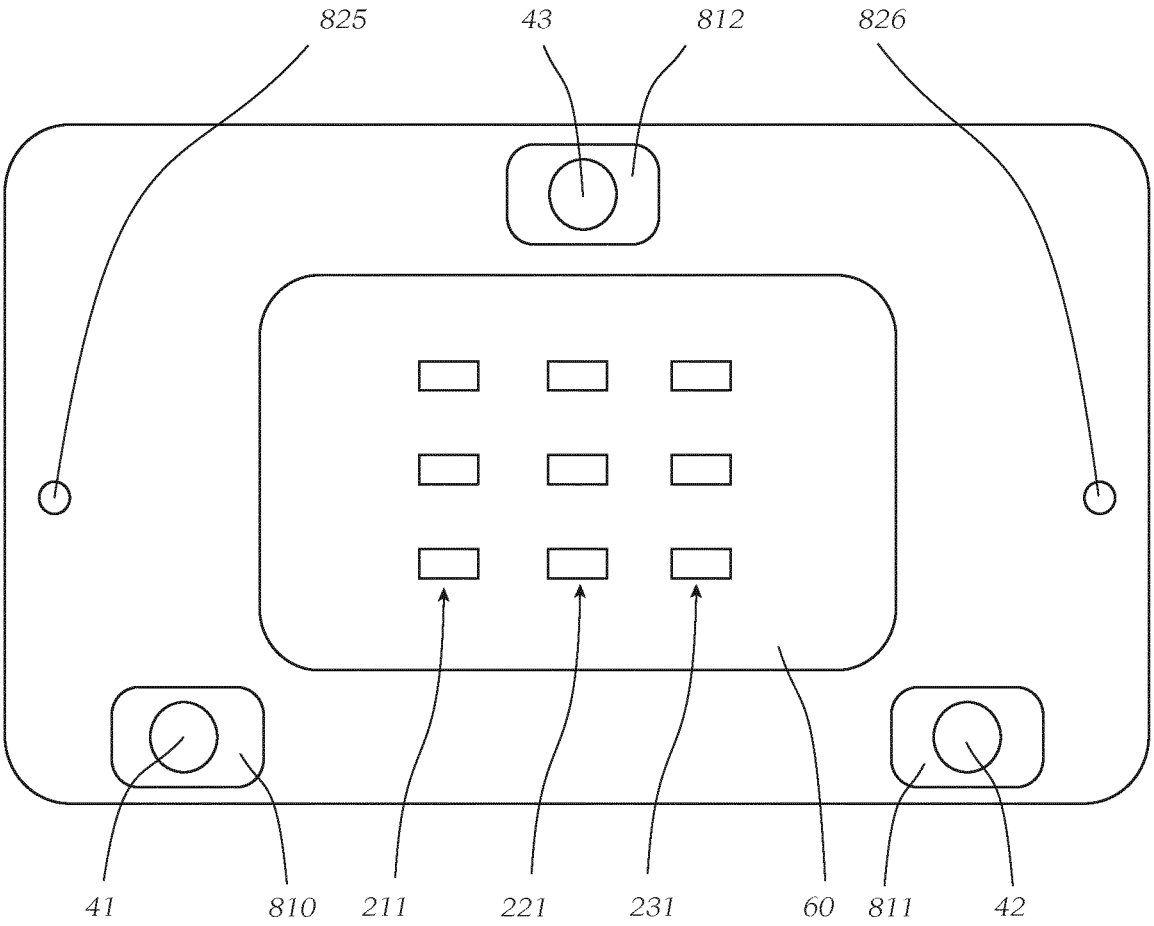

FIG. 10 shows part of the arrangement of FIG. 9, the holder 60, in a plan view. The light-incoupling surfaces 211, 221, 231, and the bearing surfaces 810, 811, 812 for the arrangement of the spacer devices 41, 42, 43, can be discerned.

The examples of embodiment in FIGS. 1 to 10 show different variants for the embodiment of the at least three spacer devices 41, 42, 43 between the circuit board 50, or a first component assembly comprising the circuit board 50 and the holder 60, 560, 660, 760, 860, or a second component assembly comprising the holder 60, 560, 660, 760, 860, at the light reference points 11, 12, 13 and the optics reference points 21, 22, 23; these variants have different advantages with respect to simplicity, ease of handling, cost, or weight, depending on the requirements.

Figure 11:
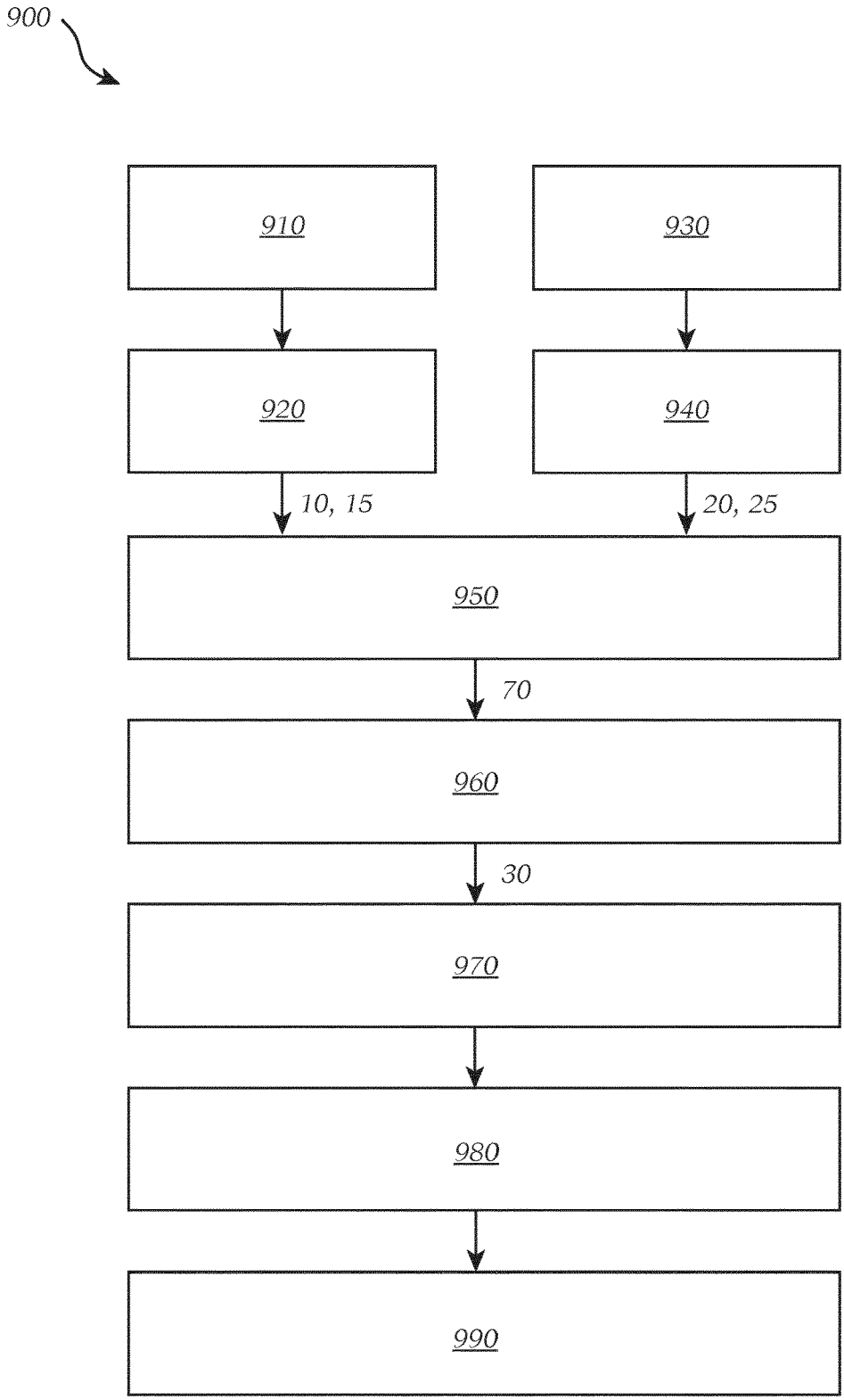
Figure 12:
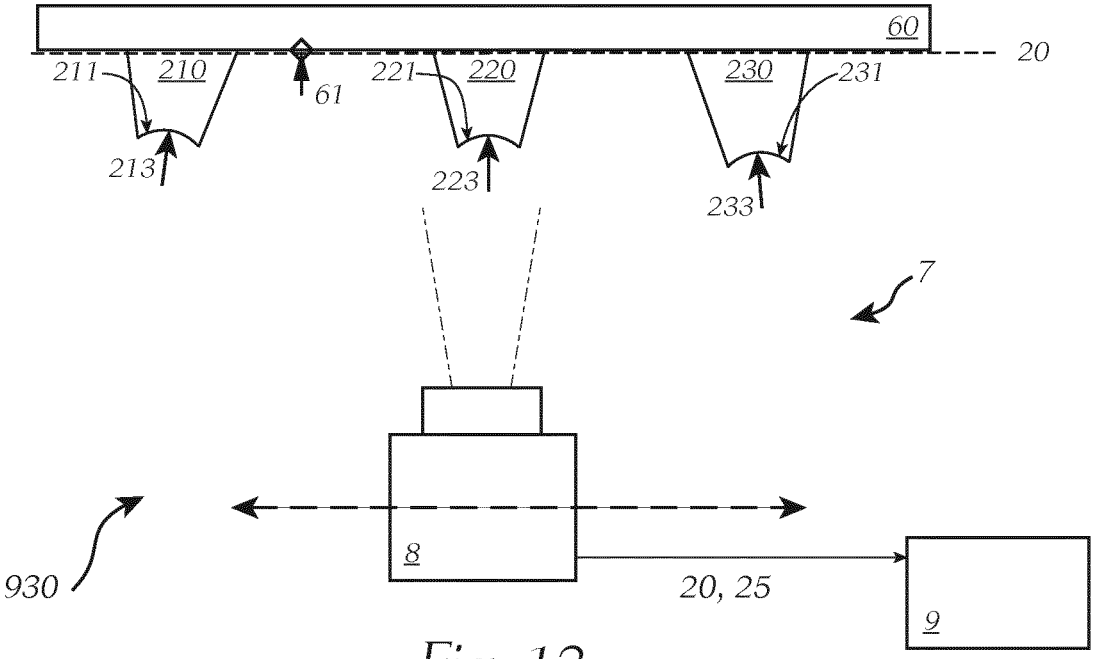
Figure 13:
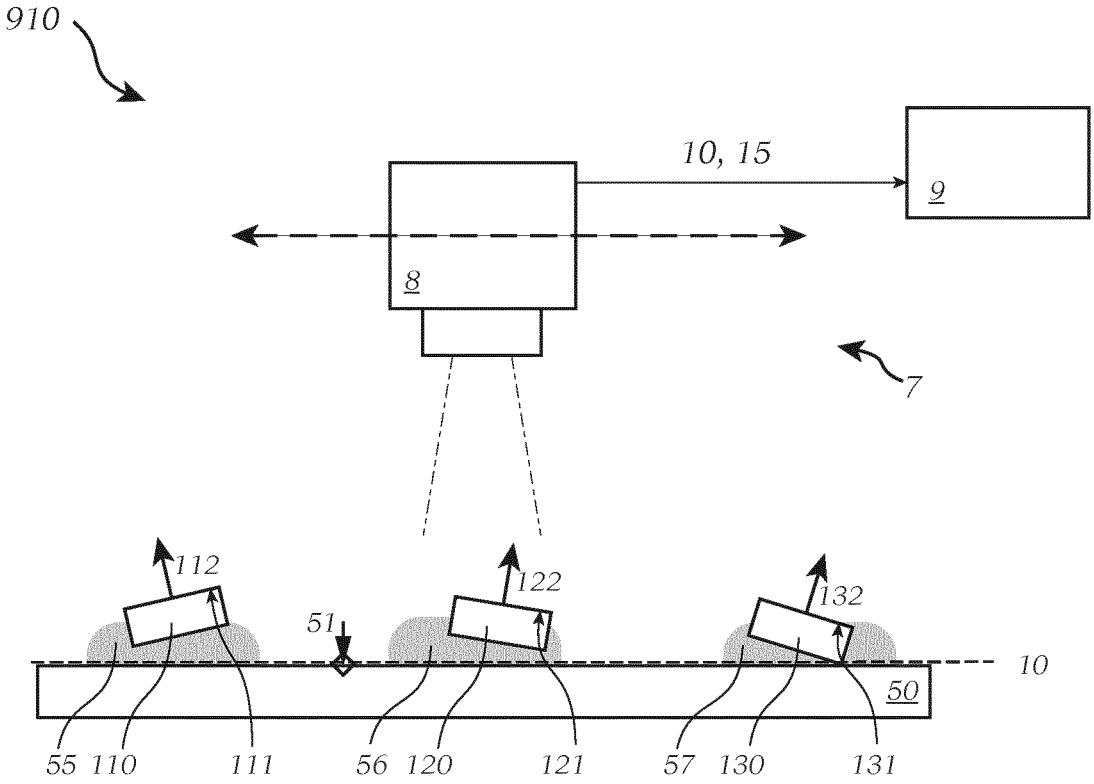

The adjustment procedure of a motor vehicle headlight can preferably be carried out by means of a method that is illustrated in FIGS. 11 to 13. The method can be applied to the motor vehicle headlights 1, 2, 3, 4, 5 of the preceding examples of embodiment in FIGS. 1 to 9, which method comprises:

the light sources 110, 120, 130 from the plurality of light sources 100, which each have a light-emitting surface 111, 121, 131, and are arranged on a common circuit board 50, and for the circuit board 50, a circuit board reference point 51 and a light reference plane 10 can be defined with respect to the circuit board 50, wherein the light reference plane 10 is defined by at least three light reference points 11, 12, 13, in which plane the circuit board reference point 51 is also located, and primary optics 210, 220, 230 from the plurality of primary optics 200, which each have a light-incoupling surface 211, 221, 231 and a light-outcoupling surface 212, 222, 232, and are held in position by a common holder 60, 560, 660, 760, 860, wherein each light source 110, 120, 130 from the plurality of light sources 100 is associated with a respective primary optics 210, 220, 230 from the plurality of primary optics 200, and each light source 110, 120, 130 from the plurality of light sources 100 is configured to emit light from the respective light-emitting surface 111, 121, 131, and to couple light into the respectively associated light-incoupling surface 211, 221, 231, and for the holder 60, 560, 660, 760, 860 a holder reference point 61 and an optics reference plane 20 can be defined with respect to the holder 60, 560, 660, 760, 860, which optics reference plane 20 is defined by at least three optics reference points 21, 22, 23, in which plane the holder reference point 61 is also located, and at least three spacer devices 41, 42, 43 are arranged between the circuit board 50, or a first component or a first component assembly, with that of the circuit board 50, and the holder 60, 560, 660, 760, 860, or a second component or a second component assembly, with the holder 60, 560, 660, 760, 860, respectively at the light reference points 11, 12, 13 and the optics reference points 21, 22, 23, wherein the lengths and orientations of the at least three spacer devices 41, 42, 43 are determined according to a transformation function 70, which describes the geometrical transformation between the circuit board reference point 51 and the holder reference point 61, and between a light reference plane 10 and an optics reference plane 20, wherein the light plane 15 is formed from the spatial position and/or orientation of the light-emitting surfaces 111, 121, 131 of the light sources 110, 120, 130 with respect to the light reference plane 10 and the circuit board reference point 51, and the optics plane 25 is formed from the spatial position and/or orientation of the light-incoupling surfaces 211, 221, 231 of the primary optics 210, 220, 230 with respect to the optics reference plane 20 and the holder reference point 61, and the light plane 15 is aligned with respect to the optics plane 25 such that as much light as possible is emitted from light-emitting surfaces (111, 121, 131) and coupled into the respectively associated light-incoupling surfaces (211, 221, 231), and a separation triplet 30 of grid point pairs 31, 32, 33 is determined from the transformation function 70, which grid point pairs 31, 32, 33 respectively extend between the light reference points 11, 12, 13 and the optics reference points 21, 22, 23, and the at least three spacer devices 41, 42, 43 implement the grid point pairs 31, 32, 33 of the separation triplet 30 with respect to magnitude and direction.

With reference to FIG. 11 the following steps are executed in the method 900:

detection 910 of the spatial position and/or orientation of the light-emitting surfaces 111, 121, 131 of the light sources 110, 120, 130 from the plurality of light sources 100 with respect to the light reference plane 10 and the circuit board reference point 51 by means of a measuring device 7, calculation 920 of the light plane 15 from the spatial positions and/or orientations of the detected light-emitting surfaces 111, 121, 131 of the light sources 110, 120, 130 from the plurality of light sources 100 by means of a computing device 9 included in the measuring device 7, detection 930 of the spatial position and/or orientation of the light-incoupling surfaces 211, 221, 231 of the primary optics 210, 220, 230 from the plurality of primary optics 200 with respect to the optics reference plane 20 and the holder reference point 61 by means of the measuring device 7, calculation 940 of the optics plane 25 from the detected spatial positions and/or orientations of the light-incoupling surfaces 211,221,231 of the primary optics 210, 220,230 from the plurality of primary optics 200 by means of the computing device 9, calculation 950 of a transformation function 70 by means of the computing device 9, determination 960 of the separation triplet 30 of grid point pairs 31, 32, 33 from the transformation function 70 by means of the computing device 9, arrangement 970 of at least three spacer devices 41, 42, 43 with heights corresponding to the transformation function between the circuit board 50 and the holder 60, 560, 660, 760, 860 at the light reference points 11, 12, 13 and the optics reference points 21, 22, 23, alignment 980 of the holder 60, 560, 660, 760, 860 in the light plane or optics plane 15, 25 according to the respective reference points 11, 12, 13, 21, 22, 23, fixing 990 the holder 60, 560, 660, 760, 860 by means of a connector device 80, 81, 580, 581,685, 686, 780, 783, 880, 881.

The method steps 910 and 920 can, as shown in FIG. 11, be carried out in parallel with the method steps 930 and 940, but can also be carried out after or before the latter.

The calculations are executed in a computing device 9, which is located, for example, within the measuring device 7.

FIG. 12 illustrates the method step 930. The measuring device 7 with a sensor 8, for example a stereoscopic camera or a laser triangulation device, has a coordinate table, on which the object to be measured is arranged. The measuring device 7 is configured to control the coordinate table for displacement movements, and to activate the sensor 8 for purposes of detecting the object accordingly, and to detect position data based on the displacement movements of the coordinate table, and to retrieve sensor data of the object from the sensor 8. Furthermore, the detected position data and sensor data can be processed for further use, and stored, for example, in a memory of the measuring device 7.

In the method step 930, the object to be measured is an optical element of the motor vehicle headlight 1 of FIG. 1, comprising primary optics 210, 220, 230 and the holder 60.

During the measurement the sensor 8 is moved over the primary optics 210, 220, 230, that is to say, the holder 60, wherein the movement of the sensor 8 is indicated by the arrows in FIG. 12.

By means of the measurements the spatial position and/or orientation of the light-incoupling surfaces 211, 221, 231 of the primary optics 210, 220, 230 from the plurality of primary optics 200 with respect to the optics reference plane 20 and the holder reference point 61 is detected by a geometrical measurement and evaluation of sensor data from the stereo camera. Thus the holder reference point 61 is also detected by the stereo camera 8, while the position of the holder reference plane 20 is determined by the measuring device 7. The determined data 20, 25 are transferred to the computing device 9.

FIG. 13 illustrates the method step 910, in which the measuring device 7 can be used with the sensor 8 as described above.

In the method step 910, the object to be measured is a light element of the motor vehicle headlight 1 of FIG. 1, comprising light sources 110, 120, 130 and the circuit board 50.

During the measurement the sensor 8 is moved over the light sources 110, 120, 130 and the circuit board 50, wherein the movement of the sensor 8 is indicated by the arrows in FIG. 13.

By means of the measurement, the spatial position and/or orientation of the light-emitting surfaces 111, 121, 131 of the light sources 110, 120, 130 from the plurality of light sources 100 with respect to the light reference plane 10 and the circuit board reference point 51 is detected by a geometric measurement and evaluation of sensor data from the stereo camera 8, while the position of the light reference plane 10 is determined by the measuring device 7. The determined data 10, 15 are transferred to the computing device 9 included in the measuring device 7.

By means of the inventive method it is achieved in a simple and cost-effective manner that the light sources and primary optics are better aligned relative to one another and thus the efficiency of the coupling of emitted light into the primary optics is improved.

A preferred further development of the method consists in the fact that, between the light-emitting surface 111, 121, 131 of the respective light source 110, 120, 130 from the plurality of light sources 100 and the light-incoupling surface 211, 221, 231 of the respectively associated primary optics 210, 220, 230 from the plurality of primary optics 200, a distance dimension 310, 320, 330, normal to the light reference plane 10 and the optics reference plane 20, which run parallel to one another, is determined by the computing device 9.

It is advantageous if a distance-of-planes 300 is determined from the distance dimensions 310, 320, 330, which is used in the calculation of the transformation function 70 to determine the distance between the circuit board 50 and the holder 60, 560, 660, 760, 860 in the circuit board reference point 51 of the circuit board 50 or in the holder reference point 61 of the holder 60, wherein the distance-of-planes 300 is preferably determined such that a predetermined minimum separation is set for all distance dimensions 310, 320, 330.

The light source 110, 120, 130 from the plurality of light sources 100 is configured to emit light from the light-emitting surface 111, 121, 131. For example, emission occurs primarily in the direction of a radiation vector 112, 122, 132. The light is coupled into the light-incoupling surface 211, 221, 231 of the respective primary optics 210, 220, 230 from the plurality of primary optics 200, for example from the direction of an incoupling vector 213, 223, 233. For each pair of light sources 110, 120, 130 and associated primary optics 210, 220, 230, a respective orientation measure thus ensues, which corresponds to the incoupling of the respectively emitted light and the respectively incoupled light, and is determined, for example, by the computing device 9, and which is preferably determined from the spatial angular difference between the radiation vector 112, 122, 132 and the incoupling vector 213, 223, 233.

The invention can advantageously be further developed if, in the calculation of the transformation function 70 from the respective orientation measure, a plane displacement 301 between the light reference plane 10 and the optics reference plane 20 with respect to the circuit board reference point 51 and the holder reference point 61 is determined, and/or a plane inclination 16, 26 about at least one axis of the light reference plane 10 and/or the optics reference plane 20 is determined. In the calculation of the transformation function 70, the plane displacement 301 is preferably determined such that the respective orientation measures are minimized, and the respective orientation measures of at least 75% of all pairs of light sources 110, 120, 130 and associated primary optics 210, 220, 230 are preferably minimized.

A pair of a light source and a primary optics is understood to be a light source that is associated with a primary optics, and in which light emitted by the light source is coupled into the light-incoupling surface of the associated primary optics.

The primary optics corresponds, for example, to a longitudinally extending light guide, which has a cross-section that increases over its length.

A primary optics in a headlight has, for example, a plurality of light guides, and a plurality of light-emitting diodes are, for example, arranged on the circuit board in the headlight.

The example of embodiment from FIG. 1 shows light-outcoupling surfaces 212, 222, 232 of the primary optics 210, 220, 230 from the plurality of primary optics 200 of the motor vehicle headlight 1, which can, for example, be located in the Petzval surface of a projection optics (not shown), which in a mounting location in a vehicle projects the light as a light pattern in front of the vehicle.

For example, the computing device 9 (see FIGS. 12 and 13) can determine the light plane 15, in which the positions of the light-emitting surfaces 111, 121, 131 of the light sources 110, 120, 130 are located approximately in the light plane 15, and/or the optics plane 25 is formed, in which the positions of the light-incoupling surfaces 211, 221, 231 of the primary optics 210, 220, 230 are located approximately in the optics plane 25, preferably by respectively determining a best-fit plane.

It is particularly beneficial if the direction of the spacer devices 41, 42, 43 is normal to the optics reference plane 20.

By means of the further developments of the inventive method, the advantages of the inventive device are also achieved.

It is evident that the above-mentioned features of further developments and forms of embodiment of the invention can be combined with one another so as to achieve further individual or combinatorial advantages.

LIST OF REFERENCE SYMBOLS

1-5 Motor vehicle headlight, Light module
7 Measuring device
8 Sensor
9 Computing device
10 Light reference plane
11, 12, 13 Light reference point
15 Light plane
16 Light angle
20 Optics reference plane
21, 22, 23 Optics reference point
25 Optics plane
26 Optics angle
30 Separation triplet
31, 32, 33 Grid point pair
41, 42, 43, 541, 542, 641, 642, 741, 742 Spacer devices
45, 46, 47, 810, 811, 812 Bearing surface
50 Circuit board
51 Circuit board reference point
55, 56, 57 Soldered joint
60, 560, 660, 760, 860 Holder
61 Holder reference point
65, 565, 665, 765, 865 Additional holder
70 Transformation function
80-83, 580-583, 680, 681, 685, 686, 880-885 Connector devices
90 Heat sink
100 Plurality of light sources
110, 120, 130 Light source
111, 121, 131 Light-emitting surface
112, 122, 132 Radiation vector
200 Plurality of primary optics
210, 220, 230 Primary optics
211, 221, 231 Light incoupling surface
212, 222, 232 Light outcoupling surface
213, 223, 233 Incoupling vector
300 Distance-of-planes
301 Plane displacement
310,320,330,311,321,331 Coupling distance
400 Circuit board orientation
401 Holder orientation
500, 501, 700, 701 Mounting clip
820, 821 Centring dome
825, 826 Centring opening
900-990 Method steps

The invention claimed is:

1. A motor vehicle headlight comprising a light module having a plurality of light sources and a plurality of primary optics, each light source being associated with a respective primary optics, wherein:

the light sources each have a light-emitting surface and are arranged on a common circuit board, the primary optics each have a light-incoupling surface and a light-outcoupling surface, and are held in position by a common holder, and each light source is configured to emit light from the respective light-emitting surface, and to couple it into the light-incoupling surface of the respective associated primary optics, wherein at least three spacer devices are provided between the circuit board, or a component or a component assembly to which the circuit board is mechanically fixedly connected, and the holder, or a component or a component assembly to which the holder is mechanically fixedly connected, wherein for the circuit board, a circuit board reference point and a light reference plane is definable with respect to the circuit board, the light reference plane being defined by at least three light reference points, wherein for the holder, a holder reference point and an optics reference plane is definable with respect to the holder, the optics reference plane being defined by at least three optics reference points, and wherein the at least three spacer devices are respectively arranged at the light reference points and the optics reference points, wherein:

a light plane is definable from the spatial position and/or orientation of the light-emitting surfaces of the light sources with respect to the light reference plane and the circuit board reference point, an optics plane is definable from the spatial position and/or orientation of the light-incoupling surfaces of the primary optics with respect to the optics reference plane and the holder reference point, the light plane is aligned with respect to the optics plane such that as much light as possible is emitted from light-emitting surfaces and coupled into the respective associated light-incoupling surfaces, the lengths and the orientations of the at least three spacer devices are determined in accordance with a transformation function, which describes the geometrical transformation between the circuit board reference point and the holder reference point as well as between a light reference plane and an optics reference plane, from the transformation function a separation triplet of grid point pairs is determined, said grid point pairs respectively extending between the light reference points and the optics reference points, the at least three spacer devices implement the grid point pairs of the separation triplet with respect to magnitude and direction, the spacer devices are realized as respective adapter plates, and respective connector devices are provided, the connector devices fastening the holder to the circuit board.

2. The motor vehicle headlight according to claim 1, wherein, starting from light emitted from the light-emitting surface, in the direction of a radiation vector, and starting from light coupled into the light-incoupling surface in the direction of an incoupling vector, for each pair of light source and associated primary optics a respective orientation measure is definable from the spatial angular difference between the radiation vector and the incoupling vector.

3. The motor vehicle headlight according to claim 2, wherein between the light reference plane and the optics reference plane with respect to the circuit board reference point and the holder reference point, a plane displacement and/or a plane inclination about at least one axis of the light reference plane and/or the optics reference plane is definable, for which the respective orientation measures are minimized.

4. The motor vehicle headlight according to claim 3, wherein the respective orientation measures of at least 75% of all pairs of light sources and associated primary optics are minimized.

5. The motor vehicle headlight according to claim 1, wherein the motor vehicle headlight corresponds to an arrangement where a distance dimension is respectively present between the light-emitting surface of the respective light source and the light-incoupling surface of the respective associated primary optics, which distance dimension is normal to the light reference plane and the optics reference plane, which in the non-adjusted state run parallel to one another.

6. The motor vehicle headlight according to claim 5, wherein a distance-of-planes is derivable from the distance dimensions by means of the transformation function, said distance-of-planes describing the distance between the circuit board and the holder in the circuit board reference point or in the holder reference point, wherein the distance-of-planes is preferably determined such that a predetermined minimum separation is set for all distance dimensions.

7. The motor vehicle headlight according to claim 1, wherein the positions of the light-emitting surfaces of the light sources are located approximately in the light plane, and/or the positions of the light-incoupling surfaces of the primary optics are located approximately in the optics plane.

8. The motor vehicle headlight according to claim 1, wherein the adapter plates are arranged between the holder and the circuit board, and the connector devices fasten the holder to the circuit board through an additional holder and a heat sink fixed to the latter.

9. The motor vehicle headlight according to claim 1, wherein the circuit board reference point is located in the light reference plane, and the holder reference point is located in the optics reference plane.

10. A motor vehicle headlight comprising:

a light module having a plurality of light sources and a plurality of primary optics, each light source being associated with a respective primary optics, wherein:

the light sources each have a light-emitting surface and are arranged on a common circuit board, the primary optics each have a light-incoupling surface and a light-outcoupling surface, and are held in position by a common holder, and each light source is configured to emit light from the respective light-emitting surface, and to couple it into the light-incoupling surface of the respective associated primary optics, wherein at least three spacer devices are provided between the circuit board, or a component or a component assembly to which the circuit board is mechanically fixedly connected, and the holder, or a component or a component assembly to which the holder is mechanically fixedly connected, wherein for the circuit board, a circuit board reference point and a light reference plane is definable with respect to the circuit board, the light reference plane being defined by at least three light reference points, wherein for the holder, a holder reference point and an optics reference plane is definable with respect to the holder, the optics reference plane being defined by at least three optics reference points, and wherein the at least three spacer devices are respectively arranged at the light reference points and the optics reference points, wherein:

a light plane is definable from the spatial position and/or orientation of the light-emitting surfaces of the light sources with respect to the light reference plane and the circuit board reference point, an optics plane is definable from the spatial position and/or orientation of the light-incoupling surfaces of the primary optics with respect to the optics reference plane and the holder reference point, the light plane is aligned with respect to the optics plane such that as much light as possible is emitted from light-emitting surfaces and coupled into the respective associated light-incoupling surfaces, the lengths and the orientations of the at least three spacer devices are determined in accordance with a transformation function, which describes the geometrical transformation between the circuit board reference point and the holder reference point as well as between a light reference plane and an optics reference plane, from the transformation function a separation triplet of grid point pairs is determined, said grid point pairs respectively extending between the light reference points and the optics reference points, the at least three spacer devices implement the grid point pairs of the separation triplet with respect to magnitude and direction, wherein the spacer devices are realized as respective adapter plates and further each have an adjustable connector device and an elastic mounting clip, wherein the mounting clip connects the holder to the circuit board.

11. The motor vehicle headlight according to claim 10, wherein the adapter plates are arranged between the holder and an additional holder, and the mounting clip connects the holder to the circuit board through the additional holder and a heat sink fixed to the latter.

12. The motor vehicle headlight according to claim 10, wherein the circuit board reference point is located in the light reference plane, and the holder reference point is located in the optics reference plane.

13. A motor vehicle headlight comprising:

a light module having a plurality of light sources and a plurality of primary optics, each light source being associated with a respective primary optics, wherein:

the light sources each have a light-emitting surface and are arranged on a common circuit board, the primary optics each have a light-incoupling surface and a light-outcoupling surface, and are held in position by a common holder, and each light source is configured to emit light from the respective light-emitting surface, and to couple it into the light-incoupling surface of the respective associated primary optics, wherein at least three spacer devices are provided between the circuit board, or a component or a component assembly to which the circuit board is mechanically fixedly connected, and the holder, or a component or a component assembly to which the holder is mechanically fixedly connected, wherein for the circuit board, a circuit board reference point and a light reference plane is definable with respect to the circuit board, the light reference plane being defined by at least three light reference points, and wherein for the holder, a holder reference point and an optics reference plane is definable with respect to the holder, the optics reference plane being defined by at least three optics reference points, wherein the at least three spacer devices are respectively arranged at the light reference points and the optics reference points, wherein:

a light plane is definable from the spatial position and/or orientation of the light-emitting surfaces of the light sources with respect to the light reference plane and the circuit board reference point, an optics plane is definable from the spatial position and/or orientation of the light-incoupling surfaces of the primary optics with respect to the optics reference plane and the holder reference point, the light plane is aligned with respect to the optics plane such that as much light as possible is emitted from light-emitting surfaces and coupled into the respective associated light-incoupling surfaces, and the lengths and the orientations of the at least three spacer devices are determined in accordance with a transformation function, which describes the geometrical transformation between the circuit board reference point and the holder reference point as well as between a light reference plane and an optics reference plane, from the transformation function a separation triplet of grid point pairs is determined, said grid point pairs respectively extending between the light reference points and the optics reference points, the at least three spacer devices implement the grid point pairs of the separation triplet with respect to magnitude and direction, and the spacer devices are realized as respective adapter plates and further comprise respective adjustable connector devices in the form of an adhesive which connects the holder to the circuit board.

14. The motor vehicle headlight according to claim 13, wherein the adapter plates are arranged between the holder and an additional holder, and the adhesive connects the holder to the circuit board through an additional holder and a heat sink fixed to the latter.

15. The motor vehicle headlight according to claim 13, wherein the circuit board reference point is located in the light reference plane, and the holder reference point is located in the optics reference plane.

16. A motor vehicle headlight comprising:

a light module having a plurality of light sources and a plurality of primary optics, each light source being associated with a respective primary optics, wherein:

the light sources each have a light-emitting surface and are arranged on a common circuit board, the primary optics each have a light-incoupling surface and a light-outcoupling surface, and are held in position by a common holder, and each light source is configured to emit light from the respective light-emitting surface, and to couple it into the light-incoupling surface of the respective associated primary optics, wherein at least three spacer devices are provided between the circuit board, or a component or a component assembly to which the circuit board is mechanically fixedly connected, and the holder, or a component or a component assembly to which the holder is mechanically fixedly connected, wherein for the circuit board, a circuit board reference point and a light reference plane is definable with respect to the circuit board, the light reference plane being defined by at least three light reference points, wherein for the holder, a holder reference point and an optics reference plane is definable with respect to the holder, the optics reference plane being defined by at least three optics reference points, and wherein the at least three spacer devices are respectively arranged at the light reference points and the optics reference points, wherein:

a light plane is definable from the spatial position and/or orientation of the light-emitting surfaces of the light sources with respect to the light reference plane and the circuit board reference point, and an optics plane is definable from the spatial position and/or orientation of the light-incoupling surfaces of the primary optics with respect to the optics reference plane and the holder reference point, the light plane is aligned with respect to the optics plane such that as much light as possible is emitted from light-emitting surfaces and coupled into the respective associated light-incoupling surfaces, the lengths and the orientations of the at least three spacer devices are determined in accordance with a transformation function, which describes the geometrical transformation between the circuit board reference point and the holder reference point as well as between a light reference plane and an optics reference plane, from the transformation function a separation triplet of grid point pairs is determined, said grid point pairs respectively extending between the light reference points and the optics reference points, the at least three spacer devices implement the grid point pairs of the separation triplet with respect to magnitude and direction, and the spacer devices comprise adjustable connector devices and elastic mounting clips, wherein the mounting clip connects the holder to the circuit board.

17. The motor vehicle headlight according to claim 16, wherein the mounting clip connects the holder to the circuit board through an additional holder and a heat sink fixed to the latter, and the connector devices fix the mounting clips to the additional holder, and the connector devices fix the mounting clips to the holder.

18. The motor vehicle headlight according to claim 16, wherein the circuit board reference point is located in the light reference plane, and the holder reference point is located in the optics reference plane.

19. A motor vehicle headlight comprising:

a light module having a plurality of light sources and a plurality of primary optics, each light source being associated with a respective primary optics, wherein:

the light sources each have a light-emitting surface and are arranged on a common circuit board, the primary optics each have a light-incoupling surface and a light-outcoupling surface, and are held in position by a common holder, and each light source is configured to emit light from the respective light-emitting surface, and to couple it into the light-incoupling surface of the respective associated primary optics, wherein at least three spacer devices are provided between the circuit board, or a component or a component assembly to which the circuit board is mechanically fixedly connected, and the holder, or a component or a component assembly to which the holder is mechanically fixedly connected, wherein for the circuit board, a circuit board reference point and a light reference plane is definable with respect to the circuit board, the light reference plane being defined by at least three light reference points, wherein for the holder, a holder reference point and an optics reference plane is definable with respect to the holder, the optics reference plane being defined by at least three optics reference points, wherein the at least three spacer devices are respectively arranged at the light reference points and the optics reference points, wherein:

a light plane is definable from the spatial position and/or orientation of the light-emitting surfaces of the light sources with respect to the light reference plane and the circuit board reference point, an optics plane is definable from the spatial position and/or orientation of the light-incoupling surfaces of the primary optics with respect to the optics reference plane and the holder reference point, the light plane is aligned with respect to the optics plane such that as much light as possible is emitted from light-emitting surfaces and coupled into the respective associated light-incoupling surfaces, the lengths and the orientations of the at least three spacer devices are determined in accordance with a transformation function, which describes the geometrical transformation between the circuit board reference point and the holder reference point as well as between a light reference plane and an optics reference plane, from the transformation function a separation triplet of grid point pairs is determined, said grid point pairs respectively extending between the light reference points and the optics reference points, the at least three spacer devices implement the grid point pairs of the separation triplet with respect to magnitude and direction, and the spacer devices formed integrally with the holder and have connector devices, which connector devices fix the holder to the circuit board.

20. The motor vehicle headlight according to claim 19, wherein the connector devices fix the holder to the circuit board via an additional holder with a bearing surface and a heat sink which is fixed to the additional holder, wherein at least one of the holder and the additional holder is adapted, with respect to shape, position or orientation of at least one of the bearing surface and a corresponding bearing surface of the holder, to achieving an optimum height for the spacer devices, and the additional holder further comprises a centring dome which interacts with a corresponding centering opening on the holder so as to achieve a desired alignment between the holder and the circuit board.

21. The motor vehicle headlight according to claim 19, wherein the circuit board reference point is located in the light reference plane, and the holder reference point is located in the optics reference plane.

22. A method for adjusting a plurality of light sources and a plurality of primary optics of a motor vehicle headlight relative to one another, wherein:

the light sources each have a light-emitting surface and are arranged on a common circuit board, for the circuit board a circuit board reference point and a light reference plane is definable with respect to the circuit board, wherein the light reference plane is defined by at least three light reference points and the primary optics each have a light-incoupling surface and a light-outcoupling surface, and are held in position by a common holder, each light source is associated with a respective primary optics, each light source is configured to emit light from the respective light-emitting surface, and to couple it into the respective associated light-incoupling surface, for the holder a holder reference point and an optics reference plane is definable relative to the holder, which optics reference plane is defined by at least three optics reference points, at least three spacer devices are provided between the circuit board, or a component or a component assembly to which the circuit board is mechanically fixed, and the holder respectively at the light reference points and the optics reference points, and the lengths and the orientations of the at least three spacer devices are determined in accordance with a transformation function, which describes the geometrical transformation between the circuit board reference point and the holder reference point as well as between a light reference plane and an optics reference plane, wherein:

a light plane is established from the spatial position and/or orientation of the light-emitting surfaces of the light sources, with respect to the light reference plane and the circuit board reference point, an optics plane is established from the spatial position and/or orientation of the light-incoupling surfaces of the primary optics, with respect to the optics reference plane and the holder reference point, the light plane is aligned with respect to the optics plane such that as much light as possible is emitted from light-emitting surfaces and coupled into the respective associated light-incoupling surfaces, and a separation triplet of grid point pairs is determined from the transformation function, which grid point pairs respectively extend between the light reference points and the optics reference points, and the at least three spacer devices implement the grid point pairs of the separation triplet with respect to magnitude and direction, the method comprising:

detecting the spatial position and/or orientation of the light-emitting surfaces of the light sources with respect to the light reference plane and the circuit board reference point using a measuring device;

calculating the light plane from the spatial positions and/or orientations of the detected light-emitting surfaces of the light sources using a computing device included in the measuring device;

detecting the spatial position and/or orientation of the light-incoupling surfaces of the primary optics with respect to the optics reference plane and the holder reference point using the measuring device;

calculating the optics plane from the detected spatial positions and/or orientations of the light-incoupling surfaces of the primary optics using the computing device;

calculating of the transformation function using the computing device;

determining a separation triplet of grid point pairs from the transformation function using the computing device;

arranging at least three spacer devices between the circuit board, or a component or a component assembly to which the circuit board is mechanically fixed, and the holder, at the light reference points and the optics reference points;

aligning the holder in the light plane or the optics plane in accordance with the respective reference points; and fixing the holder by means of at least one connector device.

23. The method according to claim 22, wherein the respective light source is configured to emit light from the light-emitting surface in the direction of a radiation vector, and to couple it into the light-incoupling surface of the respective associated primary optics from the direction of an incoupling vector, and for each pair of light sources and associated primary optics, a respective orientation measure is determined by means of the computing device, which corresponds to the incoupling of the respective emitted light and the respective incoupled light, and which is determined from the spatial angular difference between the radiation vector and the incoupling vector.

24. The method according to claim 23, wherein a plane displacement between the light reference plane and the optics reference plane is achieved with respect to the circuit board reference point and the holder reference point, and/or a plane inclination is achieved about at least one axis of the light reference plane and/or the optics reference plane, such that the respective orientation measures are minimized.

25. The method of claim 24, wherein the respective orientation measures of at least 75% of all pairs of light source and associated primary optics are minimized.

26. The method according to claim 22, wherein between the light-emitting surface of the respective light source and the light-incoupling surface of the respective associated primary optics, a respective distance dimension normal to the light reference plane and the optics reference plane, which in the non-adjusted state run parallel to one another, is determined using the computing device.

27. The method according to claim 26, wherein a distance-of-planes is determined from the distance dimensions by means of the transformation function, which distance-of-planes describes the distance between the circuit board and the holder in the circuit board reference point of the circuit board or in the holder reference point of the holder, wherein the distance-of-planes is defined such that a predetermined minimum separation is set for all distance dimensions.

28. The method according to claim 22, wherein the positions of the light-emitting surfaces of the light sources are located approximately in the light plane, and/or the positions of the light-incoupling surfaces of the primary optics are located approximately in the optics plane.

* * * * *